US009265287B2

(12) United States Patent
Sims et al.

(10) Patent No.: US 9,265,287 B2
(45) Date of Patent: Feb. 23, 2016

(54) TOBACCO CONTAINER WITH PLASTIC INSERT

(71) Applicant: Crown Packaging Technology, Inc., Alsip, IL (US)

(72) Inventors: Bart Sims, Pickerington, OH (US); Jason Pfohl, Naperville, IL (US); Galen G. German, Somerset, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/834,943

(22) Filed: Mar. 15, 2013

(65) Prior Publication Data

US 2014/0262870 A1 Sep. 18, 2014

(51) Int. Cl.
*A24F 23/00* (2006.01)
*B65D 8/00* (2006.01)

(52) U.S. Cl.
CPC ..... *A24F 23/00* (2013.01); *B65D 15/18* (2013.01); *B65D 15/24* (2013.01)

(58) Field of Classification Search
CPC ..... A24F 15/00; A24F 15/02; A24F 15/08; A24F 15/12; A24F 15/18; A24F 15/20; A24F 23/00; A24F 23/02; A24F 23/04; A24F 47/00; B65D 21/00; B65D 21/02; B65D 21/0209; B65D 21/0212; B65D 21/0215; B65D 21/0216; B65D 21/0217; B65D 21/0219; B65D 21/023; B65D 21/0233; B65D 11/00; B65D 11/02; B65D 11/1866; B65D 11/1783; B65D 11/188
USPC ..... 206/265, 266, 271, 264, 236, 504, 508; 220/4.21, 4.26, 4.27, 23.87, 23.89, 220/23.9, 737, 740, 4.01, 4.07, 8
See application file for complete search history.

(56) References Cited

U.S. PATENT DOCUMENTS

| | | | | | |
|---|---|---|---|---|---|
| 3,429,475 | A | * | 2/1969 | Scholtz | 220/257.1 |
| 5,967,875 | A | * | 10/1999 | Graef | 446/74 |
| D448,296 | S | | 9/2001 | Bried et al. | |
| D448,668 | S | | 10/2001 | Baerenwald et al. | |
| D464,567 | S | | 10/2002 | Baerenwald et al. | |
| D464,886 | S | | 10/2002 | Bried et al. | |
| D466,408 | S | | 12/2002 | Baerenwald et al. | |
| D467,801 | S | | 12/2002 | Baerenwald et al. | |
| D494,474 | S | | 8/2004 | Houk et al. | |
| D499,025 | S | | 11/2004 | Houk et al. | |
| D510,524 | S | | 10/2005 | Houk et al. | |
| D512,636 | S | | 12/2005 | Pace | |
| D513,386 | S | * | 1/2006 | Pace et al. | D9/504 |
| D514,936 | S | | 2/2006 | Pace et al. | |
| D515,426 | S | | 2/2006 | Pace et al. | |
| D515,928 | S | | 2/2006 | Pace | |

(Continued)

FOREIGN PATENT DOCUMENTS

| | | |
|---|---|---|
| DE | 7533824 | 3/1976 |
| EP | 2236433 | 10/2010 |

(Continued)

*Primary Examiner* — Steven A. Reynolds
*Assistant Examiner* — Javier A Pagan
(74) *Attorney, Agent, or Firm* — Baker & Hostetler LLP

(57) ABSTRACT

A tobacco container having a plastic insert body and a method of attaching the insert body are disclosed. Some embodiments disclose an insert body that is configured to accommodate dimensional variations in the tobacco container. Some embodiments disclose an insert body that is configured to decrease weight in the tobacco container.

11 Claims, 25 Drawing Sheets

(56) References Cited

U.S. PATENT DOCUMENTS

| | | | | |
|---|---|---|---|---|
| D523,752 | S | 6/2006 | Bried et al. | |
| D531,036 | S | 10/2006 | Bried et al. | |
| D541,176 | S | 4/2007 | Bried | |
| 7,798,319 | B1 | 9/2010 | Bried et al. | |
| D626,688 | S | 11/2010 | Gibson et al. | |
| 7,878,324 | B2 | 2/2011 | Bellamah et al. | |
| 7,954,664 | B2 | 6/2011 | Cronin et al. | |
| D651,923 | S | 1/2012 | Cronin | |
| D653,127 | S | 1/2012 | Cronin et al. | |
| 8,117,807 | B2 | 2/2012 | Bellamah et al. | |
| 8,215,482 | B2 * | 7/2012 | Cronin et al. | 206/236 |
| D664,840 | S | 8/2012 | Jones et al. | |
| 8,540,105 | B2 * | 9/2013 | Yasui | 220/380 |
| 2008/0190927 | A1 | 8/2008 | Bougoulas et al. | |
| 2008/0202956 | A1 | 8/2008 | Welk et al. | |
| 2009/0014343 | A1 | 1/2009 | Clark et al. | |
| 2010/0000888 | A1 | 1/2010 | Cronin et al. | |
| 2010/0012534 | A1 * | 1/2010 | Hoffman | 206/265 |
| 2010/0163439 | A1 * | 7/2010 | Gutierrez Avendano | 206/219 |
| 2010/0307113 | A1 | 12/2010 | Bried et al. | |
| 2012/0193265 | A1 | 8/2012 | Patel et al. | |

FOREIGN PATENT DOCUMENTS

| | | |
|---|---|---|
| EP | 2404514 | 1/2012 |
| GB | 1004671 | 9/1965 |
| WO | WO 2012/154282 | 11/2012 |

* cited by examiner

TOBACCO CONTAINER WITH PLASTIC INSERT

BACKGROUND

The present application relates to containers, and more particularly to three-piece tobacco containers that include plastic insert sleeves.

Some three-piece tobacco containers include plastic insert sleeves. U.S. Pat. Nos. 8,117,807 and 7,878,324 disclose three-piece pocket size container for holding a consumer product such as a smokeless tobacco. In both disclosures the perimeter band adjoins the container base and the container cover. The disclosures illustrate various projections disposed around the perimeter band that lock the perimeter band to the cover and base.

United States Patent Application Number 2009/0014343 discloses a three-piece pocket size hybrid container for holding smokeless tobacco. The disclosure shows the inner ring coupled to the outer base housing.

SUMMARY

In one embodiment, a tobacco container includes a lid comprising a top panel and a peripheral sidewall. The tobacco container includes a cup comprising a bottom panel and a peripheral sidewall. The tobacco container also includes an open-bottom sleeve coupled to the cup and releasably coupled to the lid. The sleeve includes a living hinge at a lower portion of the sleeve adjacent to the bottom panel of the cup.

In another embodiment, a tobacco container includes a lid comprising a top panel and a peripheral sidewall. The tobacco container includes a cup comprising a bottom panel, a peripheral sidewall, and a peripheral bead formed in the peripheral sidewall. The tobacco container also includes an open-bottom ring releasably coupled to the lid. The ring includes a peripheral bead having an upper surface and a lower surface. The bead lower surface engages the peripheral bead and the bead upper surface engages the crimp formed in the peripheral sidewall of the cup.

In another embodiment, a tobacco container includes a lid comprising a top panel and a peripheral sidewall. The tobacco container includes a cup comprising a bottom panel and a peripheral sidewall. The tobacco container also includes a clip releasably coupled to the lid. The clip includes a peripheral curl having an inner surface and an outer surface. The inner surface engages the peripheral sidewall of the cup, and the outer surface engages an inner surface of the peripheral sidewall of the lid.

In another embodiment, a tobacco container includes a lid comprising a top panel and a peripheral sidewall. The tobacco container includes a cup comprising a bottom panel and a peripheral sidewall. The tobacco container also includes a collar releasably coupled to the lid. The collar comprises a peripheral shelf that extends from an inner surface of the collar. The shelf couples to the peripheral sidewall of the cup.

In another aspect, the disclosure includes a method for crimping a tobacco container. The tobacco container includes a lid comprising a top panel and a peripheral sidewall. The tobacco container includes a cup comprising a bottom panel, a peripheral sidewall, and a peripheral bead formed in the peripheral sidewall. The tobacco container also includes an open-bottom ring releasably coupled to the lid. The ring includes a peripheral bead having an upper surface and a lower surface. The bead lower surface engages the peripheral bead and the bead upper surface engages a crimp formed in the peripheral sidewall of the cup. The method includes crimping the peripheral sidewall of the cup. The method may also include forming a seal between the ring and the peripheral sidewall of the cup.

BRIEF DESCRIPTION OF DRAWINGS

The details of one or more aspects of the disclosure are set forth in the accompanying drawings and the description below. Other features, objects, and advantages of the disclosure will be apparent from the description and drawings, and from the claims.

DETAILED DESCRIPTION

Figure 1:
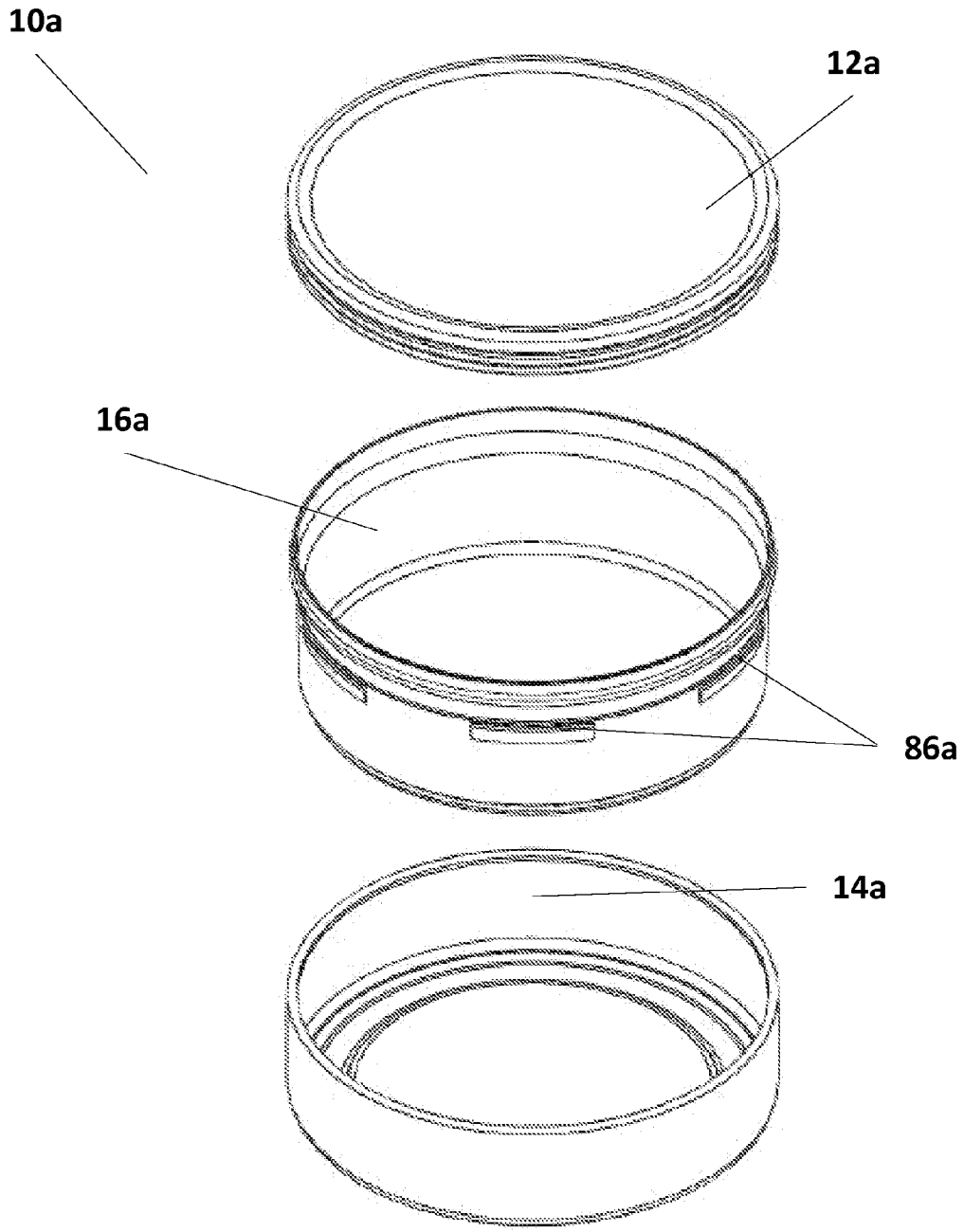
FIG. 1 illustrates a perspective exploded view of a container 10*a* that includes a lid 12*a*, cup 14*a*, and insert body 16*a*.
Figure 2A:
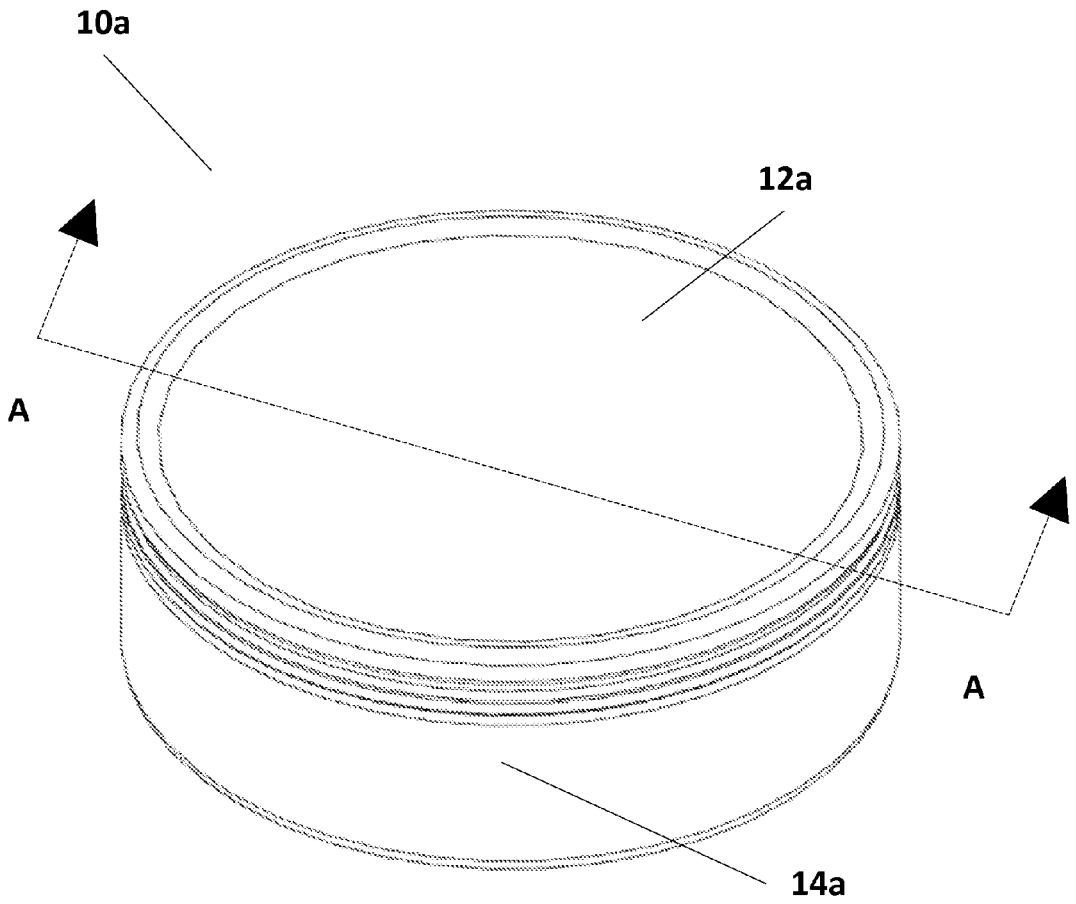
FIG. 2A illustrates a perspective view of the container 10*a* when the cup 14*a* is coupled to the insert body 16*a* and the insert body 16*a* is releasably coupled to the lid 12*a*.
Figure 2B:
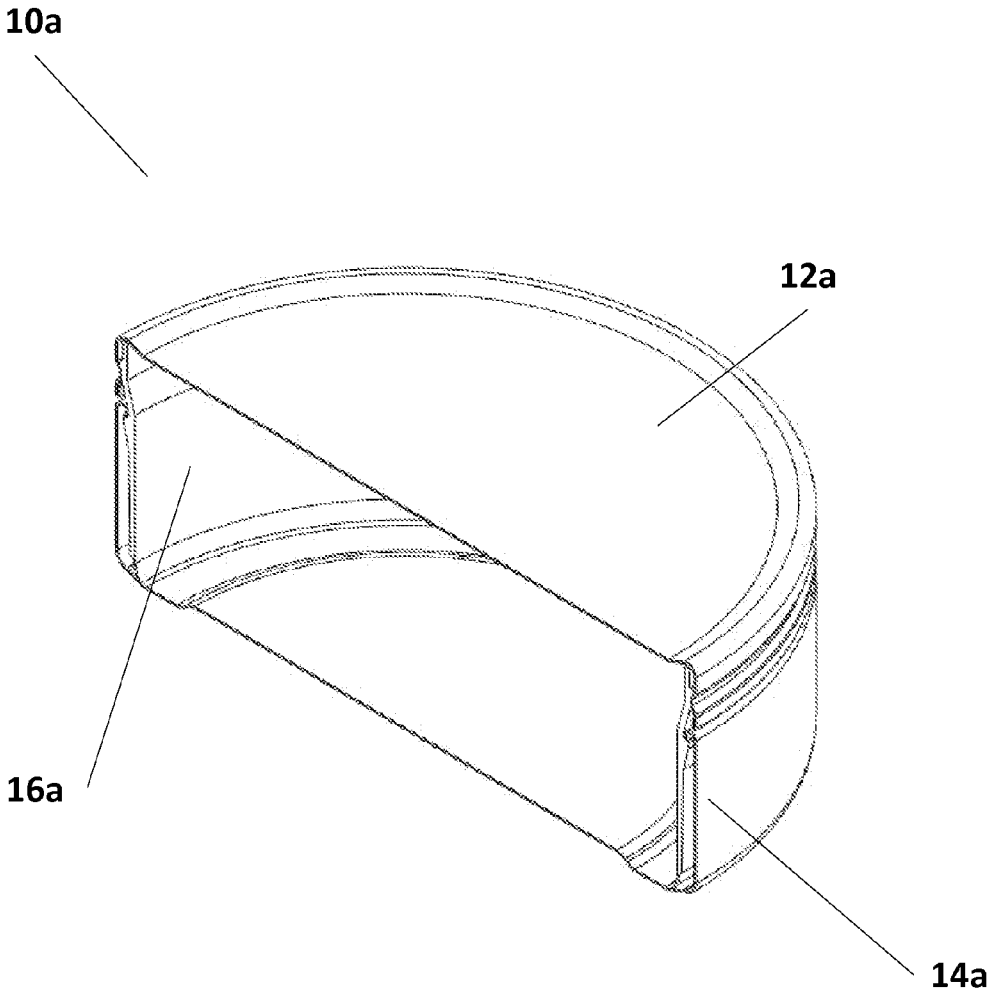
FIG. 2B illustrates a perspective cross-sectional view of the container 10*a* according to line A-A of FIG. 2A.

Three-piece containers for holding consumer food products, such as smokeless tobacco are described below. Employing reference numerals without a letter appendage to refer generally to all of the particular embodiments described below, container 10 includes an insert body 16 that is coupled to a lid 12 and a cup 14. Various embodiments of this assembly will be denoted with a letter appendage throughout this disclosure.

With reference to spatial orientation, the container 10 is centered on vertical axis V. Certain features of the container 10 may also be described in relation to planes. For example, a horizontal plane is parallel to a horizontal axis H and a depth axis Z, and perpendicular to the vertical axis V. A vertical plane is parallel to the vertical axis V and the depth axis Z, and perpendicular to the horizontal axis H. A depth plane is parallel to the depth axis Z and the horizontal axis H, and perpendicular to the vertical axis V. Furthermore, the disclosure may incorporate multiple horizontal, vertical, and depth planes by referring to first, second, and third planes.

With reference to FIGS. 1-3C, container 10*a* includes the lid 12*a*, cup 14*a*, and insert body 16*a*. The lid 12*a* includes a center panel 18*a*, an angled transition wall 19*a*, a lid heel 20*a*, and a skirt 21*a*. The skirt 21*a* extends downwardly from an outer periphery of lid heel 20*a* and includes a lid sidewall 22*a*, an angled sidewall 24*a*, a lid bead 26*a*, a bead inner peak 28*a*, a bead upper surface 30*a*, a bead lower surface 32*a*, a lid upper portion 34*a*, a lid lower portion 36*a*, a fold 38*a*, and a channel 40*a*. The illustrated embodiments show the lid 12*a* as having a circular shape; however lid 12*a* may be any suitable shape such that it is capable of coupling with the insert body 16*a*.

The center panel 18*a* is recessed relative the lid heel 20*a*. Angled transition wall 19*a* extends radially from the outermost portion of center panel 18*a* to merge with lid heel 20*a*. When the lid 12*a* is assembled to the insert body 16*a* and cup 14*a*, the center panel 18*a* and angled transition wall 19*a* form a top surface of the chamber of container 10*a*. The lid heel 20*a* may comprise a rounded edge that is defined by a radius of any suitable size. In some embodiments (not shown in the figures), the center panel 18*a* may not be recessed. For example, the center panel may be flush with the uppermost portion of heel, the center panel may extend above the heel, or the center panel may be sloped.

Lid sidewall 22*a* extends about the periphery of the center panel 18*a* from the lid heel 20*a* such that the lid sidewall 22*a* is perpendicular to the center panel 18*a*. The lid sidewall 22*a* has an annular shape that cooperates with the shape of insert body 16*a*. The sidewall may form any suitable shape that is capable of cooperating with a corresponding insert body.

Lid bead 26*a* extends radially inwardly relative to lid sidewall 22*a*. In other embodiments (not shown), the lid bead 26*a* may define any suitable shape such that it is capable of coupling with the corresponding coupling surface on the insert body 16*a*, and may be discontinuous. Lid bead 26*a* has a bead upper surface 30*a* and a bead lower surface 32*a*.

Figure 3A:
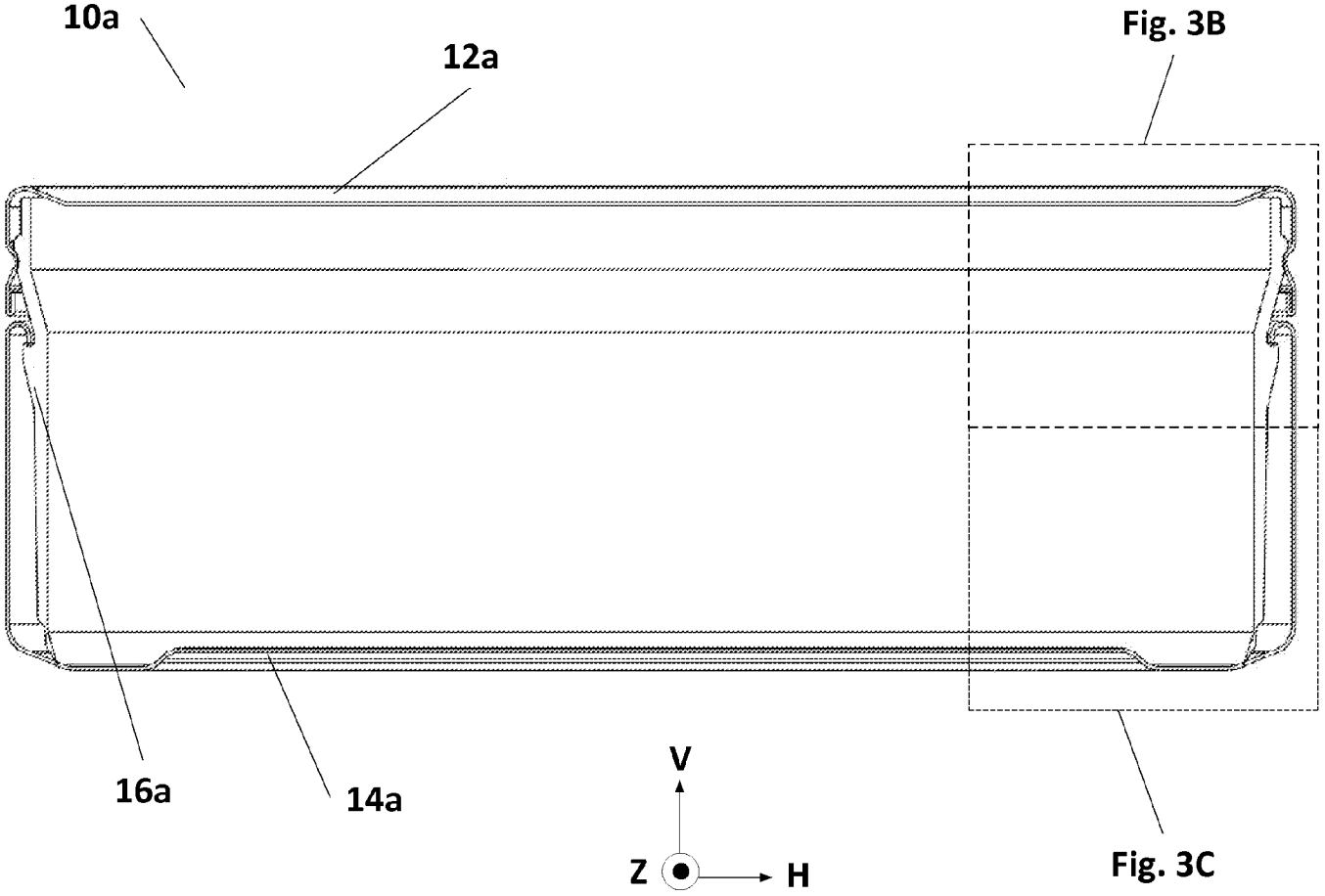
FIGS. 3A-3C illustrate various side cross-sectional views of the container 10*a*.
Figure 3B:
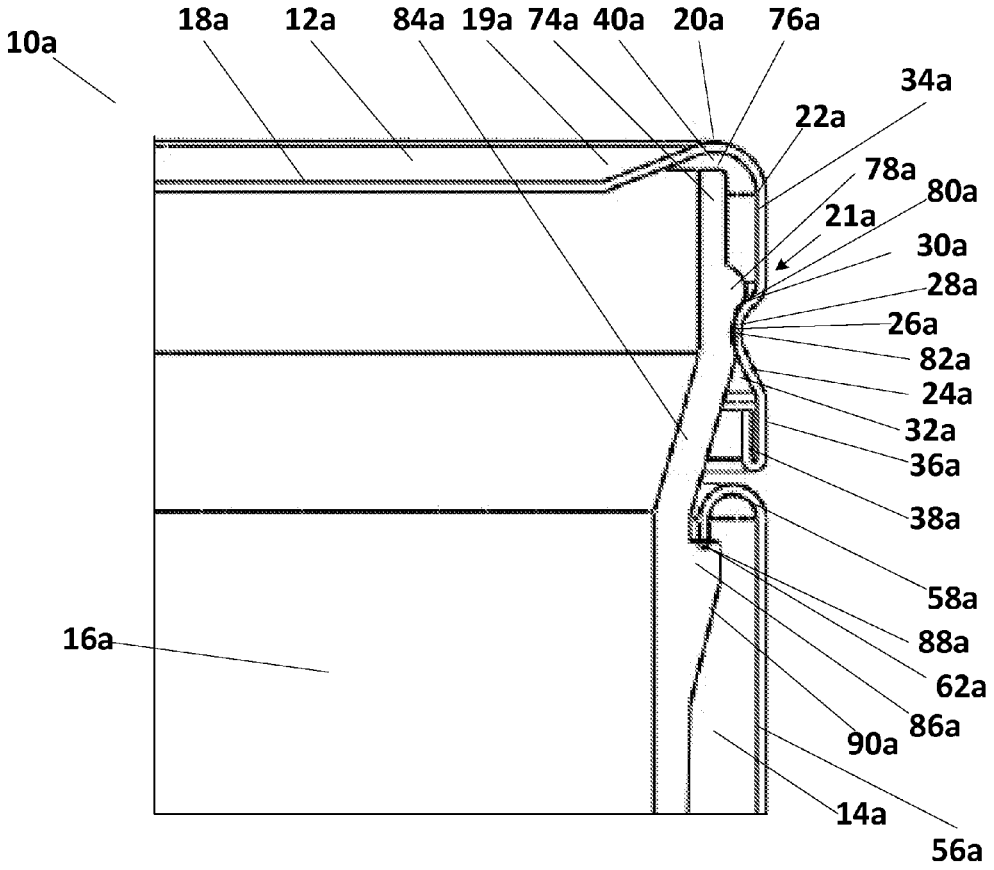
Figure 3B:
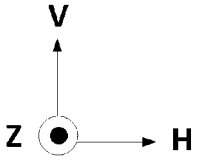
Figure 3C:
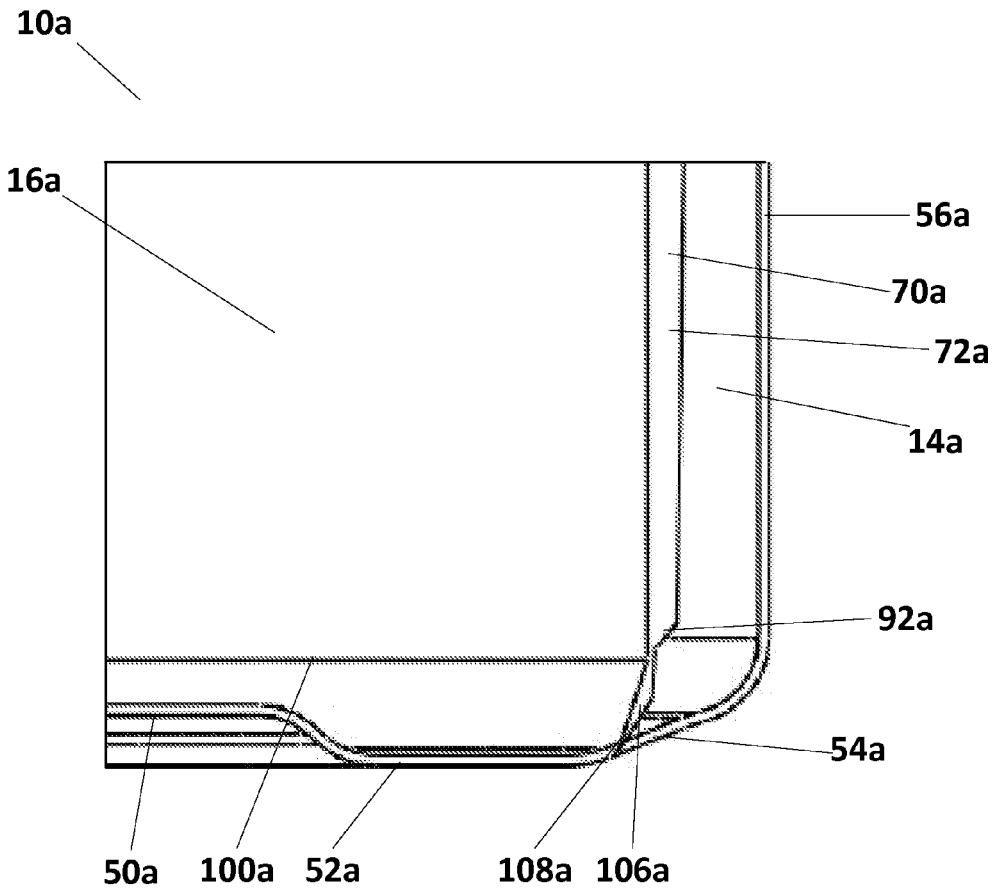
Figure 3C:
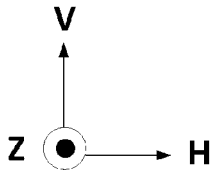
Figure 4:
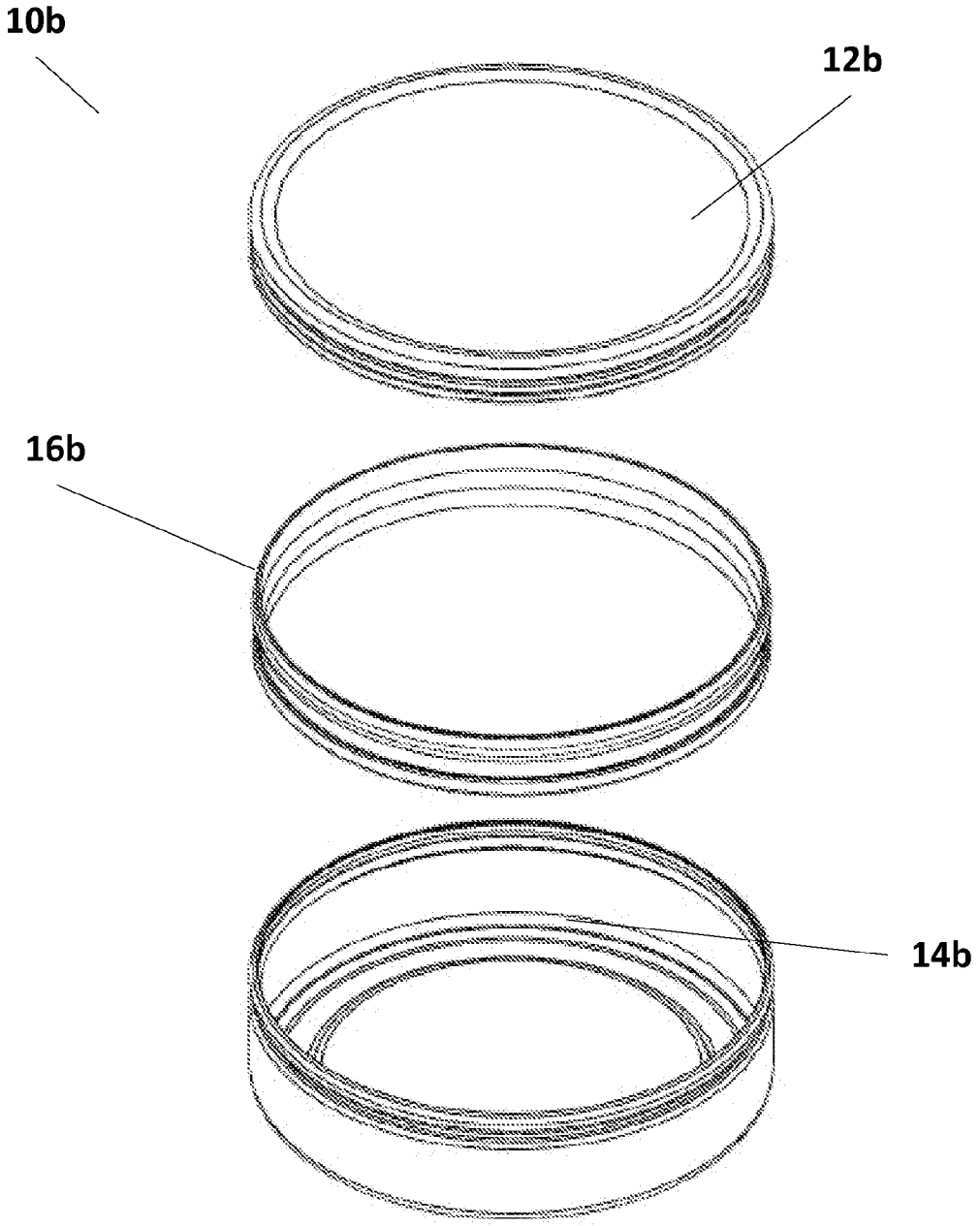
FIG. 4 illustrates a perspective exploded view of a container 10*b* that includes a lid 12*b*, cup 14*b*, and insert body 16*b*.
Figure 5A:
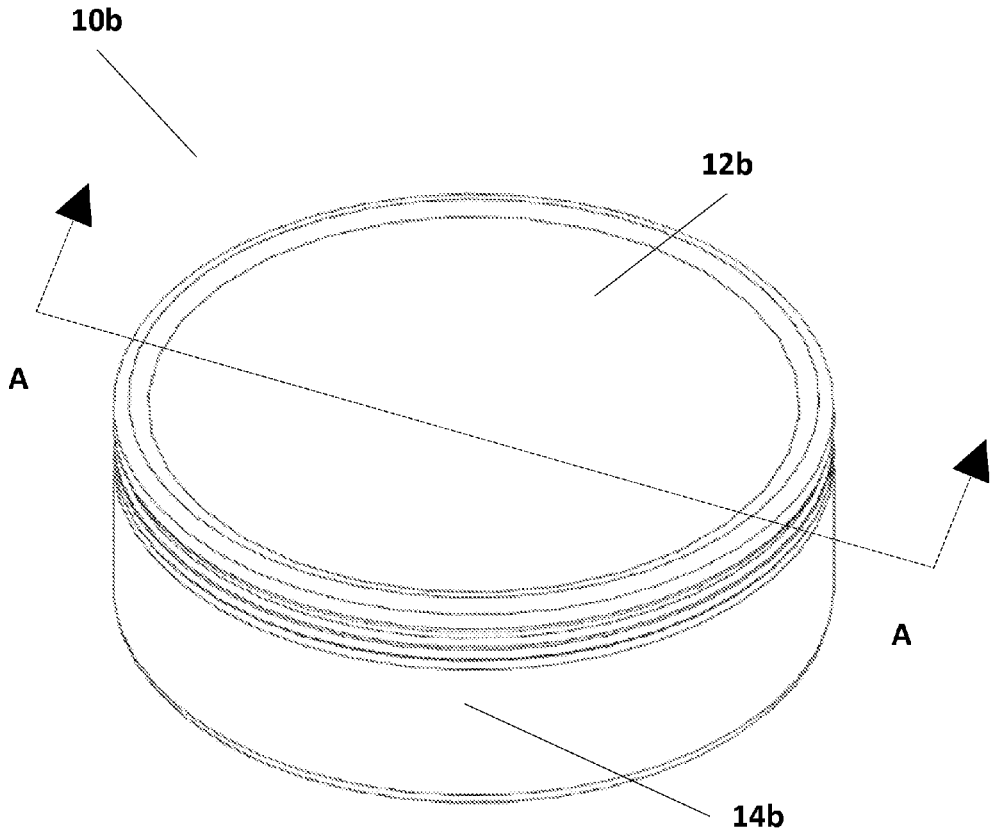
FIG. 5A illustrates a perspective view of the container 10*b* when the cup 14*b* is coupled to the insert body 16*b* and the insert body 16*b* is releasably coupled to the lid 12*b*.
Figure 5B:
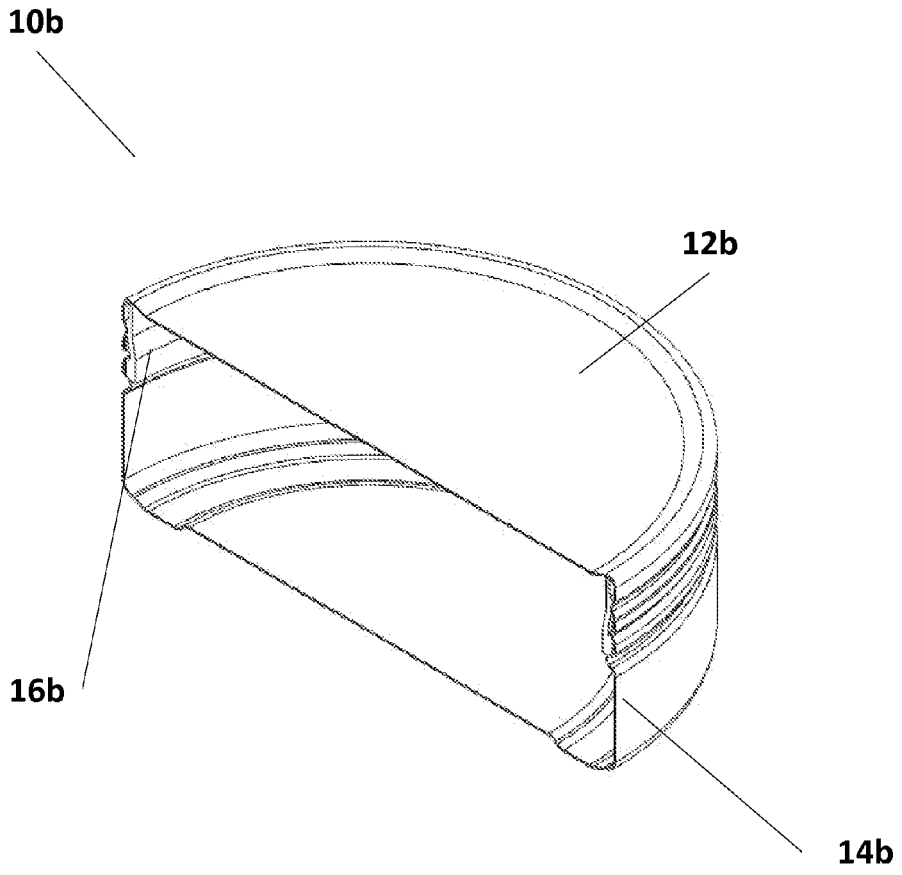
FIG. 5B illustrates a perspective cross-sectional view of the container 10*b*.

As depicted in FIG. 3B, fold 38*a* may be formed as an approximately 180° bend in the lid sidewall 22*a* that extends radially inwardly from the outer surface of the sidewall towards the vertical axis V at the bottom portion of the lid 12*a*. The fold 38*a* is configured to be proximate the neck 84*a* of the insert body 16*a*.

In some embodiments, the lid 12*a* may be configured of sheet metal of any suitable thickness. Alternatively, the lid 12*a* is constructed of other materials, such as plastic. Features of the lid 12*a* may have varying thicknesses and surface finishes with respect to one another.

With continued reference to FIGS. 1-3C, cup 14*a* includes a bottom panel 50*a*, a contact surface 52*a*, an inclined wall 54*a*, a cup sidewall 56*a*, a curl 58*a*, and a curl lip 62*a*. The figures show the cup 14*a* as having a partially cylindrical shape. In alternate embodiments, the cup may be any suitable shape such that substantially corresponds to the shape of the insert body 16*a*.

The bottom panel 50*a* extends radially outward from the vertical axis V. The bottom panel 50*a* may be planar and can define a bottom surface of the container 10*a*. The bottom panel 50*a* can be recessed (that is, spaced apart from a surface on which cup 14*a* rests). In other embodiments, the bottom panel may not be recessed. For example, the bottom panel may define a flat planar surface across the bottom surface of the cup 14*a*. Alternatively, the bottom panel 50*a* may protrude downwardly. When present, the recess may be any suitable size, in regards to width and depth.

The cup 14*a* also includes a contact surface 52*a* that may define a bottom surface of the cup 14*a*. The contact surface 52*a* extends radially outward from the bottom panel 50*a*. The inclined wall 54*a* extends radially outwardly and upwardly from the contact surface 52*a*. Cup sidewall 56*a* extends upwardly from the inclined wall 54*a*. In this manner, the cup sidewall 56*a* may define a side surface of the cup 14*a*.

As shown in FIG. 3B, curl 58*a* extends from an upper surface of the cup sidewall 56*a* and curls inward. The curl 58*a* may be an approximately 180° bend. The edge of the curl 58*a* defines the curl lip 62*a*. The curl lip 62*a* is shown as facing down, but may face up, radially inward or outward, or a direction therebetween. When the cup 14*a* is assembled to the insert body 16*a*, curl 58*a* abuts a contact surface 88*a* of the insert body 16*a*, as further discussed below.

Cup 14*a* may be configured of sheet metal, such as tinplate, of any suitable thickness. Alternatively, the cup 14*a* is constructed of other materials, such as plastic. Different features of the cup 14*a* may have varying thicknesses and surface finishes with respect to one another.

With continued reference to FIGS. 1-3C, insert body 16*a* may be a sleeve, such as an open-bottom sleeve and may include a body sidewall 70*a*, a body lower sidewall 72*a*, a body upper sidewall 74*a*, an upper lip 76*a*, a body bead 78*a*, a bead lower surface 80*a*, a bead contact surface 82*a*, a neck 84*a*, a shelf 86*a*, a contact surface 88*a*, a shelf taper 90*a*, a body taper 92*a*, a living hinge 100*a*, a cup lip 106*a*, and cup edge 108*a*. The illustrated embodiment shows the insert body 16*a* as annular, but in some embodiments (not shown); the insert body 16*a* may be any suitable shape that can be coupled to the cup 14*a* and the lid 12*a*.

The body sidewall 70*a* may define a side surface of the insert body 16*a*. The body lower sidewall 72*a* and body upper sidewall 74*a* may define a lower and upper portion of the body sidewall 70*a*, respectively. When the insert body 16*a* is assembled with the cup 14*a* and the lid 12*a*, as shown in FIGS. 2A-3C, the body lower sidewall 72*a* is adjacent to and spaced apart from the cup sidewall 56*a* and the body upper sidewall 74*a* is adjacent to the lid sidewall 22*a*.

The upper lip 76*a* is defined by the top of the body upper sidewall 74*a*. Specifically, the upper lip 76*a* is the top edge of the insert body 16*a* that is adjacent the lid heel 20*a*. The lid heel 20*a* and the upper lip 76*a* together define the channel 40*a*. The body upper sidewall 74*a* further includes the body bead 78*a*, which extends radially outward towards the lid 12*a*. In FIG. 3B the body bead 78*a* is illustrated as a round bump. In some embodiments (not shown) the body bead 78*a* may comprise any suitable shape bead that is able to extend radially outward from the insert body 16*a* and may be circumferentially discontinuous. When assembled to the lid 12*a*, the body bead 78*a* can be configured such that it abuts or is adjacent to the bead upper surface 30*a*.

The neck 84*a* may define the transition between the body upper sidewall 74*a* and the body lower sidewall 72*a*. The neck 84*a* can extend radially outward from the body lower sidewall 72*a*. As such, the neck 84 appears to taper inward from the body upper sidewall 74*a*.

The shelf 86*a* can extend radially outward from the body sidewall 70*a*. In the illustrated embodiment shown in FIG. 1, the shelf 86*a* is not continuous and instead there may be a plurality of shelves 86*a* disposed circumferentially around an outer peripheral surface of the insert body 16*a*. The shelf 86*a* may define the contact surface 88*a*, such that when the insert body 16*a* is assembled with the cup 14*a*, the contact surface 88*a* abuts the curl lip 62*a* of the cup 14*a*. The shelf 86*a* may define any suitable size or shape that is able to define a contact surface.

As the shelf 86*a* protrudes from the body lower sidewall 72*a*, the lower portion of the shelf 86*a* is defined by the shelf taper 90*a* that extends radially inward from the perimeter of the shelf 86*a*. Similar to the shelf 86*a*, the shelf taper 90*a* is not continuous and instead there may be a plurality of shelf tapers 90*a* disposed circumferentially around an outer peripheral surface of the insert body 16*a*.

The bottom portion of the body sidewall 70*a* may define a body taper 92*a* that tapers radially inward. The body taper 92*a* can be continuous and can extend around the insert body 16*a*.

The living hinge 100*a* is located at a distal end of the body taper 92*a*. The living hinge 100*a* is continuous and extends circumferentially around a peripheral surface of the insert body 16*a*. The cup lip 106*a* extends from the living hinge 100*a*. The cup lip 106*a* tapers down along the vertical axis V and away from the cup sidewall 56*a* of the cup 14*a*. The cup lip 106*a* tapers to define cup edge 108*a*. The edge may be configured to at least partially contact the corresponding contact surface 52*a* of the cup 14*a* and can also, or alternatively, at least partially contact the inclined wall 54*a* of the cup 14*a*. The living hinge 100*a* can be configured so that the cup lip 106*a* forms an obtuse angle with respect to the bottom panel 50*a*. In this manner, the cup edge 108*a* is biased inward away from cup sidewall 56*a*. Alternatively, the cup edge 108*a* can flex outward toward the cup sidewall 56*a*.

Insert body 16*a* and cup 14*a* may be further configured to form a snap-fit in relation to one another. Specifically, insert body 16*a* may be pressed into cup 14*a* such that the shelf taper 90*a* slides along the curl 58*a* until the curl lip 62*a* snaps onto the shelf 86*a*, securing the insert body 16*a* to the cup 14*a*. The insert body 16*a* may include a plastic material, such as polypropylene. The plastic material can be any plastic suitable of resisting corrosion, which may allow the interior space of the container 10*a* to store moist contents for long periods of time. The plastic material may also be configured to be elastic, such that when the insert body 16*a* is coupled with the cup 14*a* and releasably coupled with the lid 12*a* that the insert body 16*a* does not deform or become damaged during coupling. The insert body 16*a* may also be configured to have sufficient rigidity such that when the lid 12*a* and cup 14*a* are coupled to the insert body 16*a* that the lid 12*a* and the cup 14*a* will tend to retain the coupled configuration.

The lid 12*a* is configured to releasably couple with the insert body 16*a*, which in turn couples with the cup 14*a*. When the lid 12*a*, cup 14*a*, and insert body 16*a* are all coupled together, container 10*a* is in a closed state. In the closed state the user may securely store contents within the interior space of the container 10*a*, such as smokeless tobacco. When the lid 12*a* is decoupled from the insert body 16*a* and cup 14*a*, this may define container 10*a* in an open state. When container 10*a* is in an open state, this may allow the user to gain access to the stored contents within the interior space of the container 10*a*.

The lid 12*a* and the cup 14*a* may be configured such that a plurality of containers 10*a* can be stacked on top of one another. Inclined wall 54*a* of a cup can be inclined at an angle that corresponds to angled transition wall 19*a* such that container 10*a* can register with another, like container. In this manner, the center panel 18*a* may receive a corresponding protruding interface located along the bottom of a second container 10*a*, as defined by the bottom panel 50*a*.

The inventors also surmise that the center panel 18*a* may be recessed in order to minimize denting in the top surface of the lid 12*a*. Because the center panel 18*a* may be recessed this may not only define a smaller upper horizontal surface area, but also may increase the strength of the top surface of the lid 12*a* to resist denting. The inventors also surmise that denting may be minimized because the overall weight of the container 10*a* may be less than a container that has an insert body with a bottom portion. Additionally, inclined wall 54*a* also stiffens sidewall 56*a* and provides a shorter sidewall compared with a sidewall that extends downward to a contact surface datum. Therefore, if cup 14*a* is assembled to insert body 16*a* and shipped loose to a brand owner or other filler, the assembly is likely less prone to denting because of the relatively light weight and the relatively short sidewall, which provides a smaller area to dent as the loose assemblies 14*a*/16*a* move loose to one another.

The lid sidewall 22*a*, specifically the lid upper portion 34*a*, may be configured to allow the lid bead 26*a*, and bead upper surface 30*a* to flex as the lid 12*a* is releasably coupled with the insert body 16*a*. Furthermore, the lid sidewall 22*a* and lid upper portion 34*a* may be constructed of a material and thickness that is capable of repeated coupling and decoupling of the lid 12*a* with the insert body 16*a*.

The bead inner peak 28*a* may structurally reinforce the lid 12*a* to retain the mechanical interference fit with the insert body 16*a*. The bead inner peak 28*a* may also serve as a gripping surface for the user when the user releasably couples and decouples the lid 12*a* from the insert body 16*a*.

The fold 38*a* of the lid 12*a* may be configured to structurally reinforce the lid 12*a* to retain the coupled position with the insert body 16*a*. The lid lower portion 36*a* and the fold 38*a* may also serve as a gripping surface for the user when the user couples and decouples the lid 12*a* from the insert body 16*a*. The fold 38*a* may also serve to provide a smooth surface that is comfortable and safe to touch by the user. In this manner, the fold 38*a* may protect the user's hands from engaging sharp metal edges during the coupling and decoupling process.

The channel 40*a* may serve as a pathway for air to travel from outside the container 10*a* into the interior space of the container 10*a*. In this manner, the channel 40*a* may allow for the contents of the container to be ventilated. This may reduce unwanted growth of bacteria and other organisms within the interior of the container 10*a*. In addition to allowing ventilation, the channel 40*a* can also be configured to allow for movement of the lid 12*a*. In this manner, the lid 12*a* and the upper lip 76*a* of the insert body 16*a* may be configured such that they do not contact each other when the container 10*a* is closed. Because the lid 12*a* may not come into contact with the upper lip 76*a*, this may reduce stress on the lid 12*a*.

The channel 40*a* may be configured to allow for dimensional inaccuracies that may result from tolerances shifting in the lid 12*a*, cup 14*a*, and insert body 16*a*. For example, if the body upper sidewall 74*a* is longer than expected, the channel 40*a* may be configured to have sufficient space to accommodate the extra length. Or, the channel 40*a* may be configured to accommodate various degrees of thermal expansion and contraction in the lid 12*a*, cup 14*a*, and the insert body 16*a*. In this manner, the lid 12*a*, cup 14*a*, and insert body 16*a* can comprise different materials and can be exposed to extreme temperature variations.

The living hinge 100*a* can be configured to flex such that the cup lip 106*a* and the cup edge 108*a* are able to pivot relative to the body sidewall 70*a* of the insert body 16*a* and the contact surface 52*a* and/or the inclined wall 54*a* of the cup 14*a*. During the coupling of the insert body 16*a* with the cup

14*a*, the living hinge 100*a* can be configured to flex such that the cup lip 106*a* moves in relation to the cup 14*a*.

Because the living hinge 100*a* can be configured to flex, the living hinge 100*a* may accommodate dimensional variations in the cup 14*a* and the insert body 16*a*. In addition, the living hinge 100*a* may flex to accommodate various degrees of thermal expansion and contraction. In this manner, the cup lip 106*a* is configured to move relative to the cup 14*a* and still maintain contact between the cup edge 108*a* and the bottom surface of the cup 14*a*. Additionally, the living hinge 100*a* may also be configured to have a slight compression, such that a small degree of potential energy is stored in the living hinge 100*a*. Accordingly, the living hinge 100*a* provides the cup edge 108*a* with a slight force against the bottom surface of cup 14*a*. The inventors surmise that this force may also prevent the contents of the container from leaking out underneath the cup edge 108*a*. Furthermore, this force may also press shelf 86*a* against the curl lip 62*a*.

Turning now to the second embodiment as shown in FIGS. 4-6C, container 10*b* includes the lid 12*b*, cup 14*b*, and insert body 16*b*. The lid 12*b* includes a center panel 18*b*, an angled transition wall 19*b*, a lid heel 20*b*, and a skirt 21*b*. The skirt 21*b* extends downwardly from an outer periphery of lid heel 20*b* and includes a lid sidewall 22*b*, an angled sidewall 24*b*, a lid bead 26*b*, a bead inner peak 28*b*, a bead upper surface 30*b*, a bead lower surface 32*b*, a lid upper portion 34*b*, a lid lower portion 36*b*, a fold 38*b*, and a channel 40*b*. The illustrated embodiments show the lid 12*b* as having a circular shape; however lid 12*b* may be any suitable shape such that it is capable of coupling with the insert body 16*b*.

The center panel 18*b* is recessed relative the lid heel 20*b*. Angled transition wall 19*b* extends radially from the outermost portion of center panel 18*b* to merge with lid heel 20*b*. When the lid 12*b* is assembled to the insert body 16*b* and cup 14*b*, the center panel 18*b* and angled transition wall 19*b* form a top surface of the chamber of container 10*b*. The lid heel 20*b* may comprise a rounded edge that is defined by a radius of any suitable size. In some embodiments (not shown in the figures), the center panel 18*b* may not be recessed. For example, the center panel may be flush with the uppermost portion of heel, the center panel may extend above the heel, or the center panel may be sloped.

Lid sidewall 22*b* extends about the periphery of the center panel 18*b* from the lid heel 20*b* such that the lid sidewall 22*b* is perpendicular to the center panel 18*b*. The lid sidewall 22*b* has an annular shape that cooperates with the shape of insert body 16*b*. The sidewall may form any suitable shape that is capable of cooperating with a corresponding insert body.

Lid bead 26*b* extends radially inwardly relative to lid sidewall 22*b*. In other embodiments (not shown), the lid bead 26*b* may define any suitable shape such that it is capable of coupling with the corresponding coupling surface on the insert body 16*b*, and may be discontinuous. Lid bead 26*b* has a bead upper surface 30*b* and a bead lower surface 32*b*.

Figure 6A:
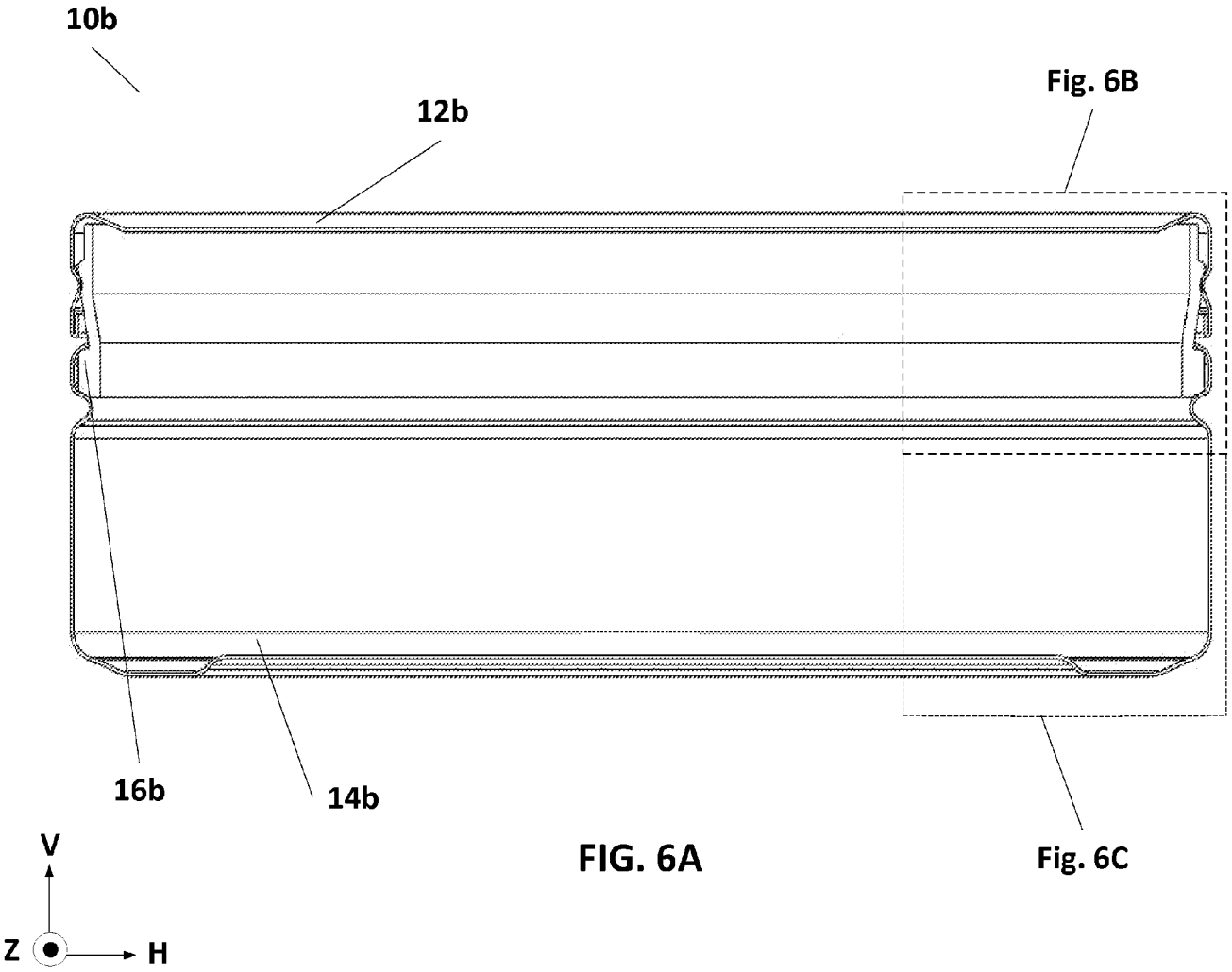
FIGS. 6A-6C illustrate various side cross-sectional views of the container 10*b*.
Figure 6B:
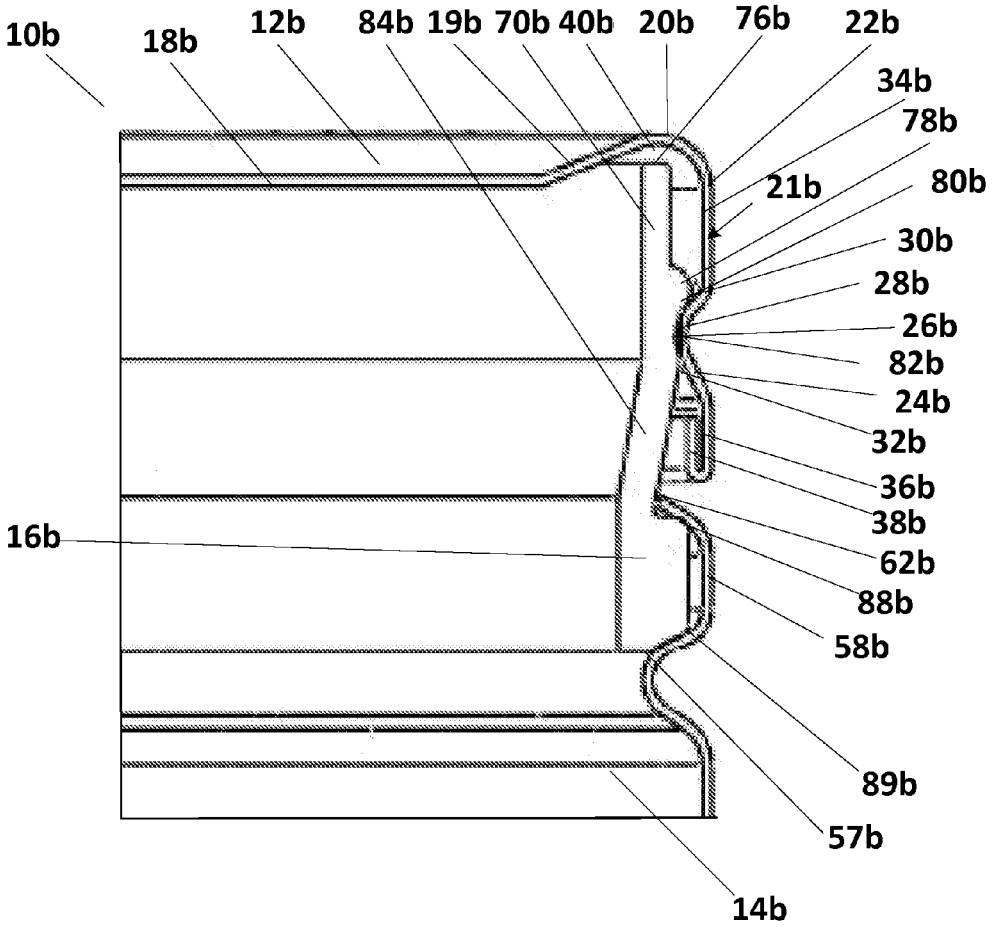
Figure 6B:
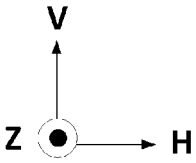
Figure 6C:
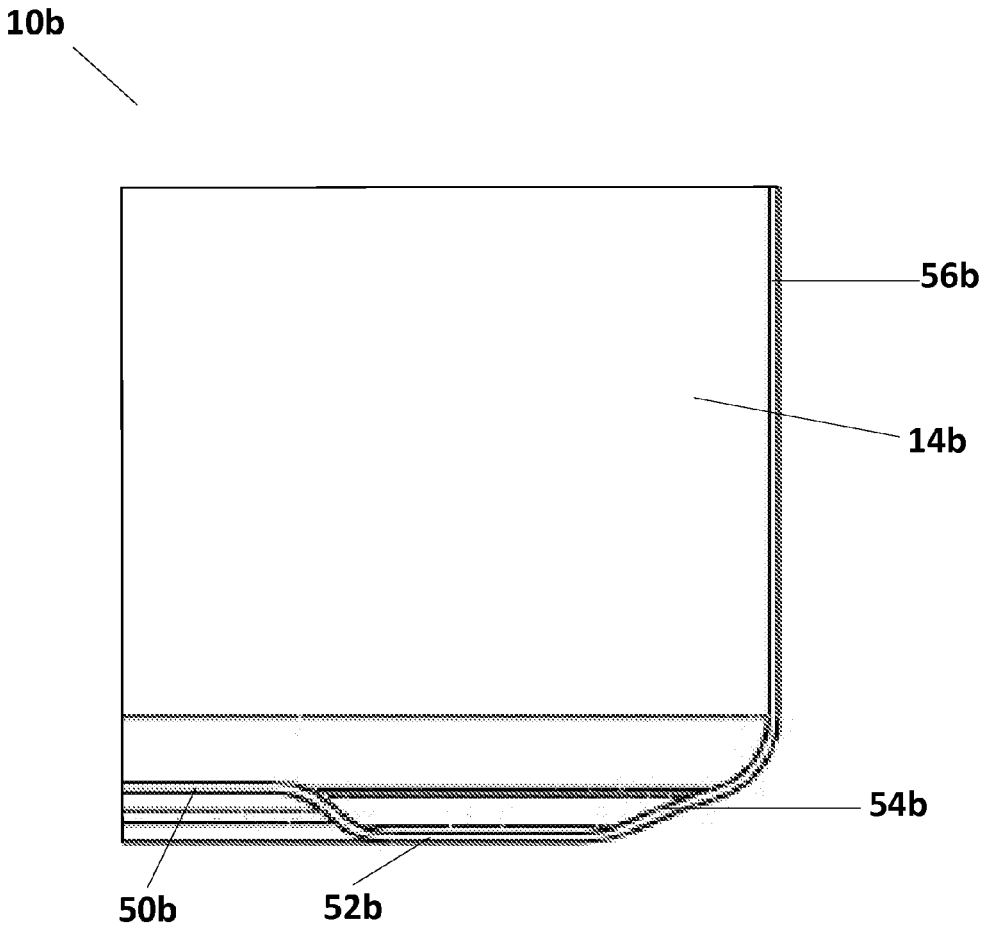
Figure 6C:
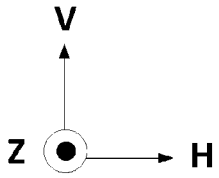

As depicted in FIG. 6B, fold 38*b* may be formed as an approximately 180° bend in the lid sidewall 22*b* that extends radially inwardly from the outer surface of the sidewall towards the vertical axis V at the bottom portion of the lid 12*b*. The fold 38*b* is configured to be proximate the neck 84*b* of the insert body 16*b*.

In some embodiments, the lid 12*b* may be configured of sheet metal of any suitable thickness. Alternatively, the lid 12*b* is constructed of other materials, such as plastic. Features of the lid 12*b* may have varying thicknesses and surface finishes with respect to one another.

With continued reference to FIGS. 4-6C, cup 14*b* includes a bottom panel 50*b*, a contact surface 52*b*, an inclined wall 54*b*, a cup sidewall 56*b*, a cup upper sidewall 58*b*, and a cup crimp 62*b*. The figures show the cup 14*b* as having a partially cylindrical shape. In alternate embodiments, the cup may be any suitable shape such that substantially corresponds to the shape of the insert body 16*b*.

The bottom panel 50*b* extends radially outward from the vertical axis V. The bottom panel 50*b* may be planar and can define a bottom surface of the container 10*b*. The bottom panel 50*b* can be recessed (that is, spaced apart from a surface on which cup 14*b* rests). In other embodiments, the bottom panel may not be recessed. For example, the bottom panel may define a flat planar surface across the bottom surface of the cup 14*b*. Alternatively, the bottom panel 50*b* may protrude downwardly. When present, the recess may be any suitable size, in regards to width and depth.

The cup 14*b* also includes a contact surface 52*b* that may define a bottom surface of the cup 14*b*. The contact surface 52*b* extends radially outward from the bottom panel 50*b*. The inclined wall 54*b* extends radially outwardly and upwardly from the contact surface 52*b*. Cup sidewall 56*b* extends upwardly from the inclined wall 54*b*. In this manner, the cup sidewall 56*b* may define a side surface of the cup 14*b*.

As shown in FIG. 6B, cup upper sidewall 58*b* extends from cup inner bead 57*b* and curls inward. The edge of the cup upper sidewall 58*b* defines the cup crimp 62*b*. The cup crimp 62*b* is shown as facing radially inward, but may face down, up, radially outward, or a direction therebetween. When the cup 14*b* is assembled to the insert body 16*b*, the cup upper sidewall 58*b* abuts a body upper contact surface 88*b* of the insert body 16*b*, as further discussed below.

Cup 14*b* may be configured of sheet metal, such as tinplate, of any suitable thickness. Alternatively, the cup 14*b* is constructed of other materials, such as plastic. Different features of the cup 14*b* may have varying thicknesses and surface finishes with respect to one another.

With continued reference to FIGS. 4-6C, insert body 16*b* may be a ring, such as an open bottom ring and may include a body sidewall 70*b*, an upper lip 76*b*, a body bead 78*b*, a bead lower surface 80*b*, a bead contact surface 82*b*, a body upper contact surface 88*b*, and a body lower contact surface 89*b*. When the insert body 16*b* is assembled to the cup 14*b* and the lid 12*b*, the body sidewall 70*b* may define a side surface of the insert body 16*b* and the container 10*b*. The illustrated embodiment shows the insert body 16*a* as annular, but in some embodiments (not shown); the insert body 16*b* may be any suitable shape that can be coupled to the cup 14*b* and the lid 12*b*.

The upper lip 76*b* is defined by the top of the body sidewall 70*b*. Specifically, the upper lip 76*b* is the top edge of the insert body 16*b*, adjacent the lid heel 20*b*. The lid heel 20*b* and the upper lip 76*b* together define the channel 40*b*. The body sidewall 70*b* further includes the body bead 78*b*, which extends radially outward towards the lid 12*b*. In FIG. 6B the body bead 78*b* is illustrated as a round bump. In some embodiments (not shown) the body bead 78*b* may comprise any suitable shape bead that is able to extend radially outward from the insert body 16*b* and may be circumferentially discontinuous. When assembled to the lid 12*b*, the body bead 78*b* can be configured such that it abuts or is adjacent to the bead upper surface 30*a*.

The insert body 16*b* may define the body upper contact surface 88*b* and the body lower contact surface 89*b*, such that when the insert body 16*b* is assembled with the cup 14*b*, the body upper contact surface 88*b* and body lower contact surface 89*b* may abut or be adjacent to the corresponding surfaces of the cup upper sidewall 58*b*, the cup inner bead 57*b* and/or the cup crimp 62*b* of the cup 14*b*. The body upper contact surface 88*b* and body lower contact surface 89*b* may be continuous and extend circumferentially around an outer peripheral surface of the insert body 16*b*. In some embodiments, the body upper contact surface 88*b* and body lower contact surface 89*b* may define any suitable sizes or shapes that are able to define surfaces that are capable of coupling with the cup 14*b*.

Figure 7:
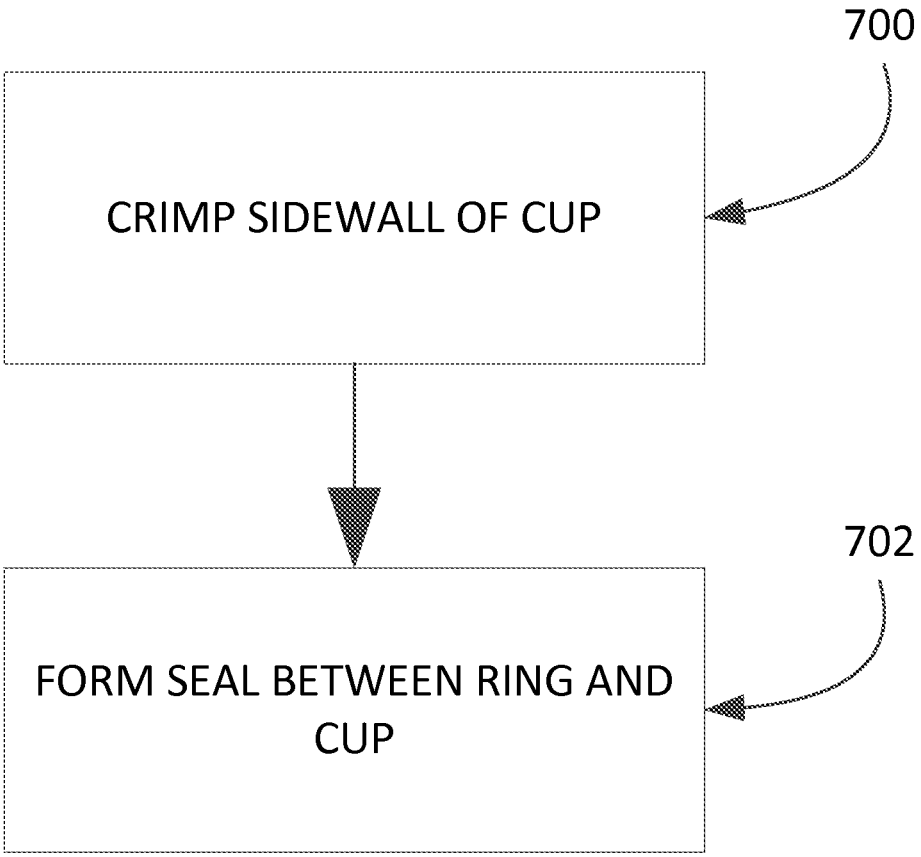
FIG. 7 illustrates a method for crimping the cup 14*b* to the insert body 16*b*.
Figure 8:
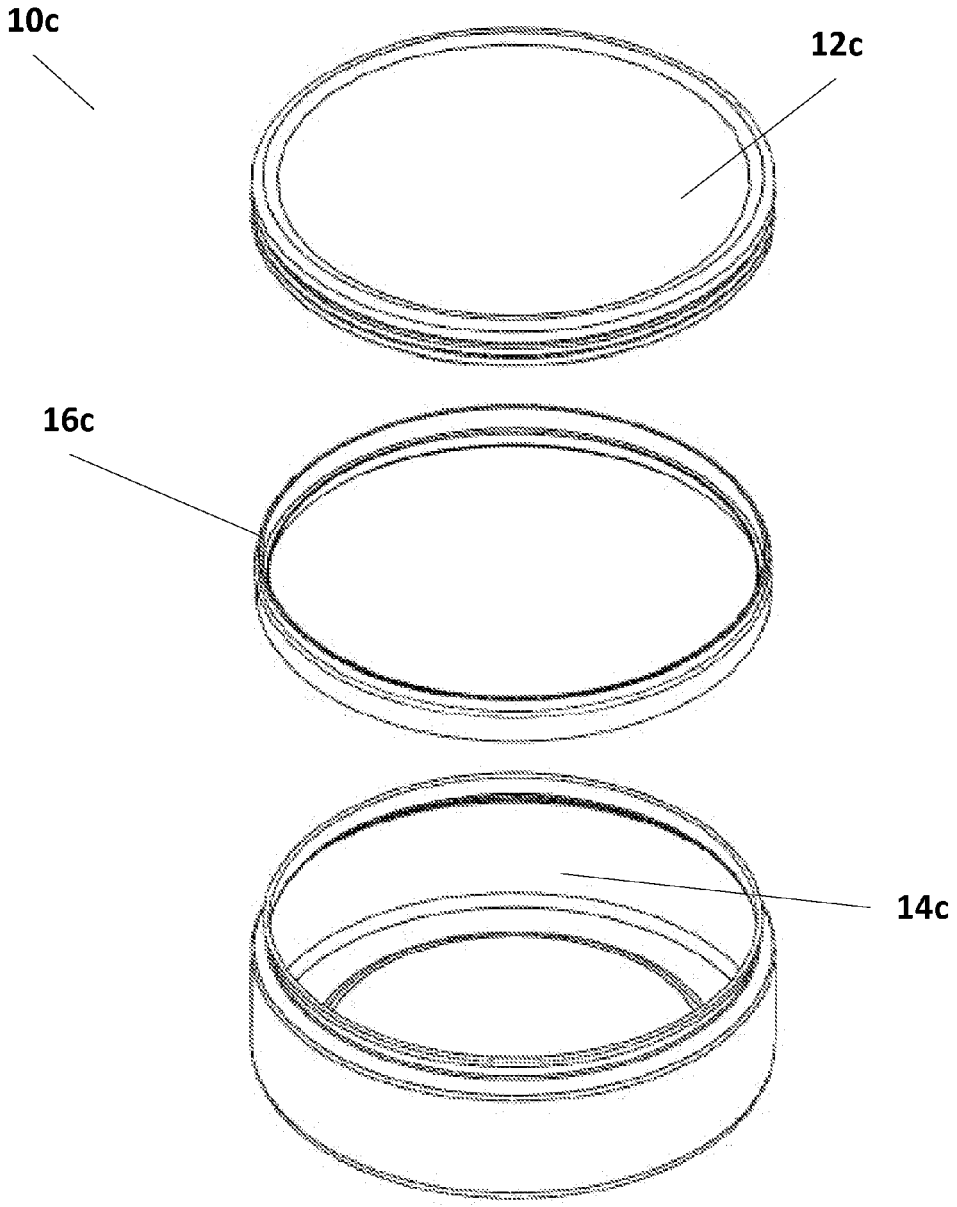
FIG. 8 illustrates a perspective exploded view of a container 10*c* that includes a lid 12*c*, cup 14*c*, and insert body 16*c*.
Figure 9A:
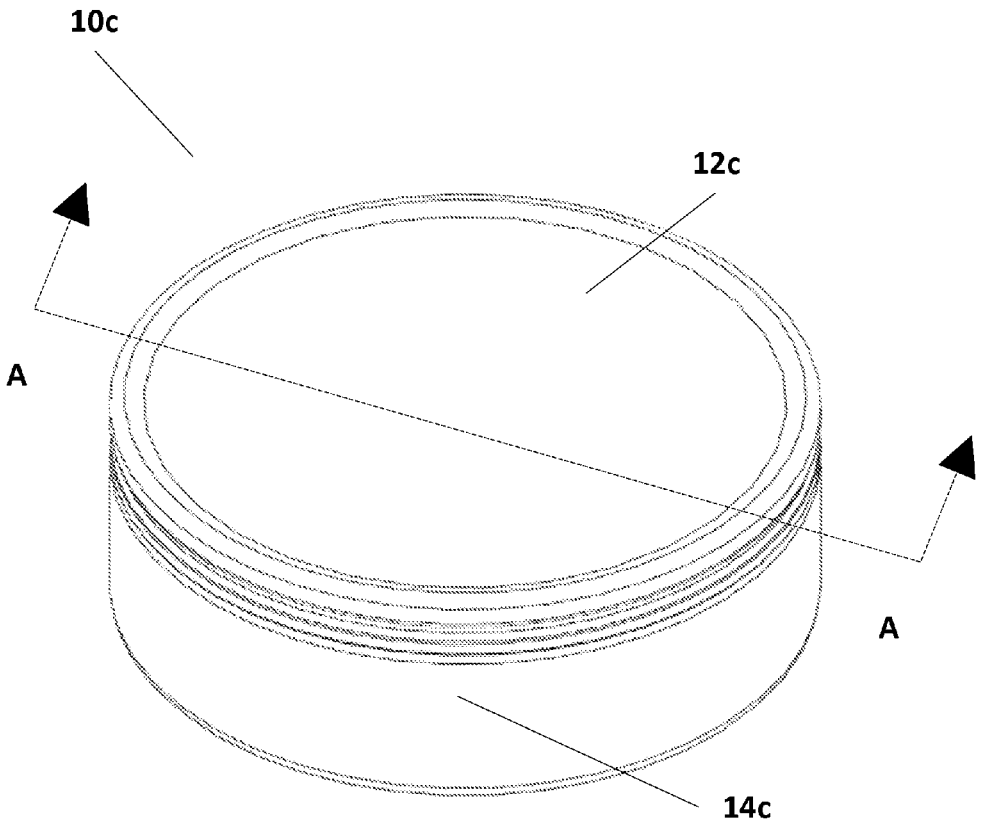
FIG. 9A illustrates a perspective view of the container 10*c* when the cup 14*c* is coupled to the insert body 16*c* and the insert body 16*c* is releasably coupled to the lid 12*c*.
Figure 9B:
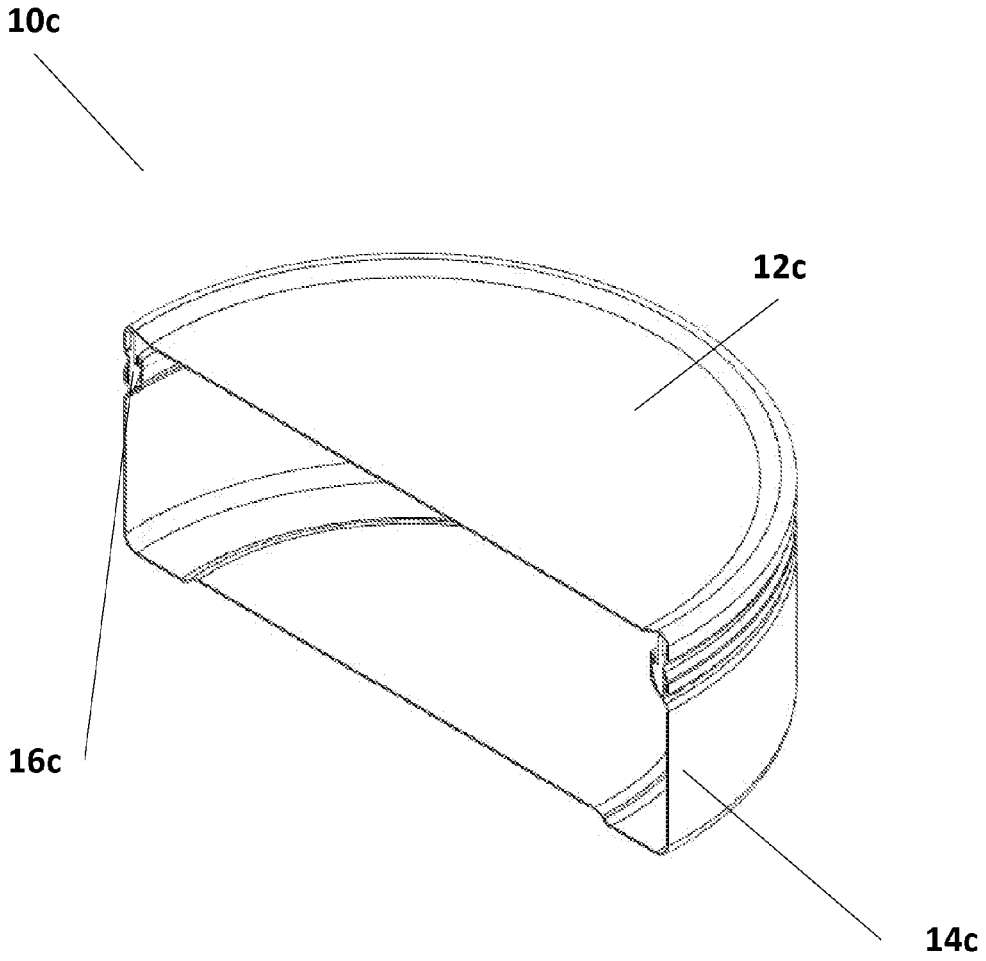
FIG. 9B illustrates a perspective cross-sectional view of the container 10*c*.

The insert body 16*b* may be made of a plastic material, such as polypropylene, which may allow the interior space of the container 10*b* to store moist contents for long periods of time. The plastic material may also be configured to be elastic, such that when the insert body 16*b* is coupled with the cup 14*b* and releasably coupled with the lid 12*b* that the insert body 16*b* does not deform or become damaged during coupling. The insert body 16*b* may also be configured to have sufficient rigidity such that when the lid 12*b* and cup 14*b* are coupled to the insert body 16*b* that the lid 12*b* and the cup 14*b* will tend to retain the coupled configuration Referring to FIG. 7, the insert body 16*b* may be coupled to the cup 16*b* by a crimping process. Specifically, after the insert body 16*b* is positioned within the cup 16*b* such that the bottom portion of the insert body rests on the cup inner bead 57*b*, cup upper sidewall 58*b* may be bent radially inward toward the body upper contact surface 88*b* of the insert body 16*b*, so as to crimp the cup crimp 62*b* against the body upper contact surface 88*b*. The step of crimping the cup sidewall 56*b* is shown at step 700. By coupling the insert body 16*b* to the cup 16*b*, a seal may be formed between the insert body 16*b* and the cup sidewall 56*b*, as identified at step 702.

The lid 12*b* is configured to releasably couple with the insert body 16*b*, which in turn couples with the cup 14*b*. When the lid 12*b*, cup 14*b*, and insert body 16*b* are coupled together, this may define container 10*b* in a closed state. In the closed state the user may securely store contents within the interior space of the container 10*b*, such as smokeless tobacco. When the lid 12*b* is decoupled from the insert body 16*b* and cup 14*b*, this may define container 10*b* in an open state. When container 10*b* is an open state, this may allow the user to gain access to the stored contents within the interior space of the container 10*b*.

The lid 12*b* and the cup 14*b* may be configured such that a plurality of containers 10*b* can be stacked on top of one another. Inclined wall 54*b* of a cup can be inclined at an angle that corresponds to angled transition wall 19*b* such that container 10*b* can register with another, like container. In this manner, the center panel 18*b* may receive a corresponding protruding interface located along the bottom of a second container 10*b*, as defined by the bottom panel 50*b*.

The inventors also surmise that the center panel 18*b* may be recessed in order to minimize denting in the top surface of the lid 12*b*. Because the center panel 18*b* may be recessed this may not only define a smaller horizontal surface, but also may increase the strength of the top surface of the lid 12*b*. The inventors also surmise that denting may be minimized because the overall weight of the container 10*b* may be less than a container that has an insert body with a bottom portion, or an insert body such as 16*a* that extends to the bottom of the cup 14*a*. Additionally, inclined wall 54*b*, also stiffens sidewall 56*b* and provides a shorter sidewall compared with a sidewall that extends downward to a contact surface datum. Therefore, if cup 14*b* is assembled to insert body 16*b* and shipped loose to a brand owner or other filler, the assembly is likely less prone to denting because of the relatively light weight and the relatively short sidewall, which provides a smaller area to dent as the loose assembles 14*b*/16*b* move loose to one another.

The lid sidewall 22*b*, specifically the lid upper portion 34*b*, may be configured to allow the lid bead 26*b*, and bead upper surface 30*b* to flex as the lid 12*b* is releasably coupled with the insert body 16*b*. Furthermore, the lid sidewall 22*b* and lid upper portion 34*b* may be constructed of a material and thickness that is capable of repeated coupling and decoupling of the lid 12*b* with the insert body 16*b*.

The bead inner peak 28*b* may structurally reinforce the lid 12*b* to retain the mechanical interference fit with the insert body 16*b*. The bead inner peak 28*b* may also serve as a gripping surface for the user when the user releasably couples and decouples the lid 12*b* from the insert body 16*b*.

Fold 38*b* may be configured to structurally reinforce the lid 12*b* to retain the coupled position with the insert body 16*b*. The lid lower portion 36*b* and the fold 38*b* may also serve as a gripping surface for the user when the user couples and decouples the lid 12*b* from the insert body 16*b*. The fold 38*b* may also serve to provide a smooth surface that is comfortable and safe to touch by the user. In this manner, the fold 38*b* may protect the user's hands from engaging sharp metal edges during the coupling and decoupling process.

The channel 40*b* may serve as a pathway for air to travel from outside the container 10*b* into the interior space of the container 10*b*. In this manner, the channel 40*b* may allow for the contents of the container to be ventilated. This may reduce unwanted growth of bacteria and other organisms within the interior space of the container 10*b*. In addition to allowing ventilation, the channel 40*b* can also be configured to allow for movement of the lid 12*b*. In this manner, the lid 12*b* and the upper lip 76*b* of the insert body 16*b* may be configured such that they do not contact each other when the container 10*b* is closed. Because the lid 12*b* may not come into contact with the upper lip 76*b*, this may reduce stress on the lid 12*b*.

In some embodiments, the channel 40*b* may be configured to allow for dimensional inaccuracies that may result from tolerances shifting in the lid 12*b*, cup 14*b*, and insert body 16*b*. For example, if the insert body 16*b* is longer than expected, the channel 40*b* may be configured to have sufficient space to accommodate the extra length. In some embodiments, the channel 40*b* may be configured to accommodate various degrees of thermal expansion and contraction in the lid 12*b*, cup 14*b*, and the insert body 16*b*. In this manner, the lid 12*b*, cup 14*b*, and insert body 16*b* can comprise different materials and can be exposed to extreme temperature variations.

Turning now to the third embodiment shown in FIGS. 8-10C, container 10*c* includes the lid 12*c*, cup 14*c*, and insert body 16*c*. The lid 12*c* includes a center panel 18*c*, an angled transition wall 19*c*, a lid heel 20*c*, and a skirt 21*c*. The skirt 21*c* extends downwardly from an outer periphery of lid heel 20*c* and includes a lid sidewall 22*c*, an angled sidewall 24*c*, a lid bead 26*c*, a bead inner peak 28*c*, a bead upper surface 30*c*, a bead lower surface 32*c*, a lid upper portion 34*c*, a lid lower portion 36*c*, a fold 38*c*, and a channel 40*c*. The illustrated embodiments show the lid 12*c* as having a circular shape; however, lid 12*c* may be any suitable shape such that it is capable of coupling with the insert body 16*c*.

The center panel 18*c* is recessed relative the lid heel 20*c*. Angled transition wall 19*c* extends radially from the outermost portion of center panel 18*c* to merge with lid heel 20*c*. When the lid 12*c* is assembled to the insert body 16*c* and cup 14*c*, the center panel 18*c* and angled transition wall 19*c* form a top surface of the chamber of container 10*c*. The lid heel 20*c* may comprise a rounded edge that is defined by a radius of any suitable size. In some embodiments (not shown in the figures), the center panel 18*c* may not be recessed. For example, the center panel may be flush with the uppermost portion of heel, the center panel may extend above the heel, or the center panel may be sloped.

Lid sidewall 22*c* extends about the periphery of the center panel 18*c* from the lid heel 20*c* such that the lid sidewall 22*c* is perpendicular to the center panel 18*c*. The lid sidewall 22*c* has an annular shape that cooperates with the shape of insert body 16*c*. The sidewall may form any suitable shape that is capable of cooperating with a corresponding insert body.

Lid bead 26*c* extends radially inwardly relative to lid sidewall 22*c*. In other embodiments (not shown), the lid bead 26*c* may define any suitable shape such that it is capable of coupling with the corresponding coupling surface on the insert body 16*c*, and may be discontinuous. Lid bead 26*c* has a bead upper surface 30*c* and a bead lower surface 32*c*.

Figure 10A:
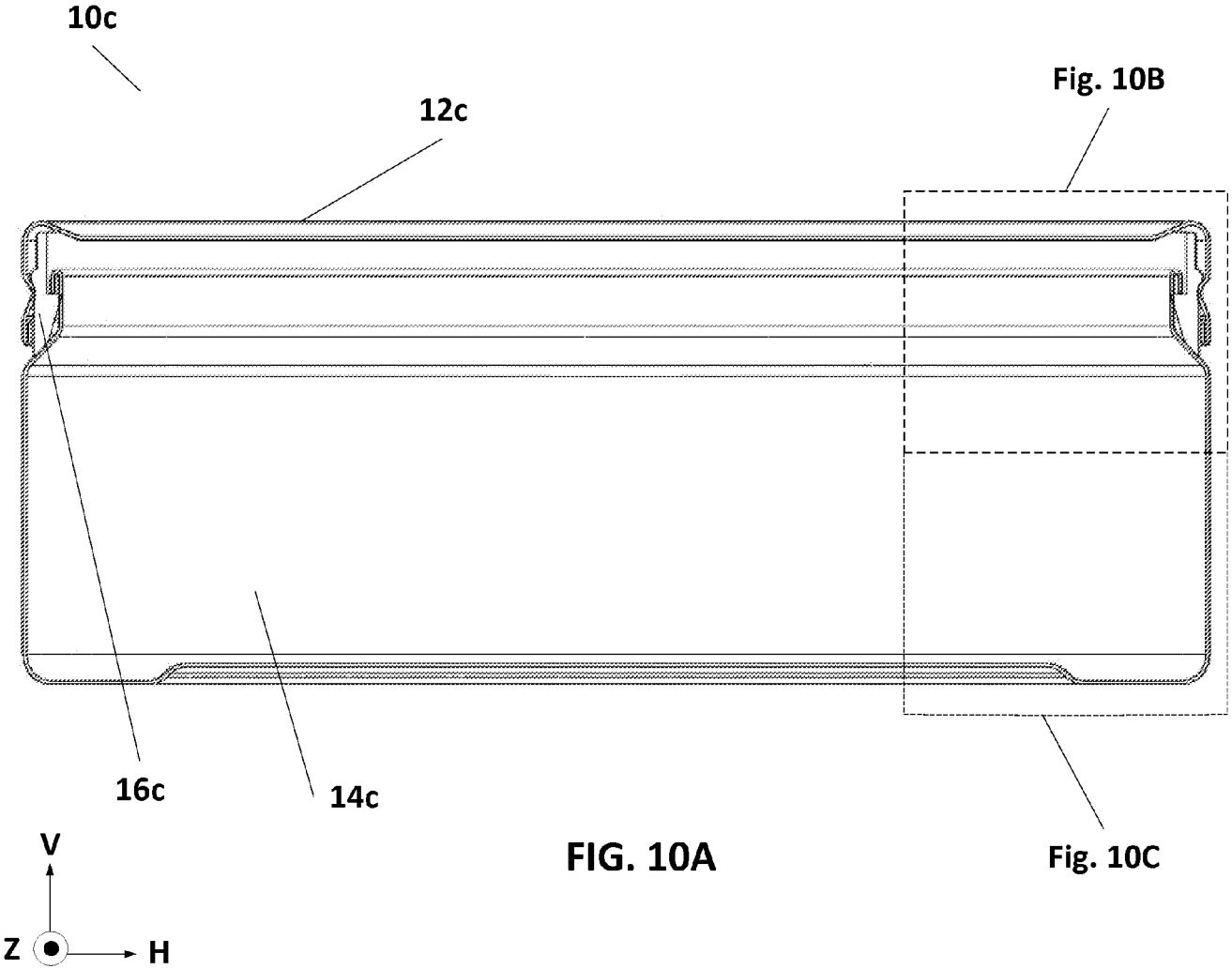
FIGS. 10A-10C illustrate various side cross-sectional views of the container 10*c*.
Figure 10B:
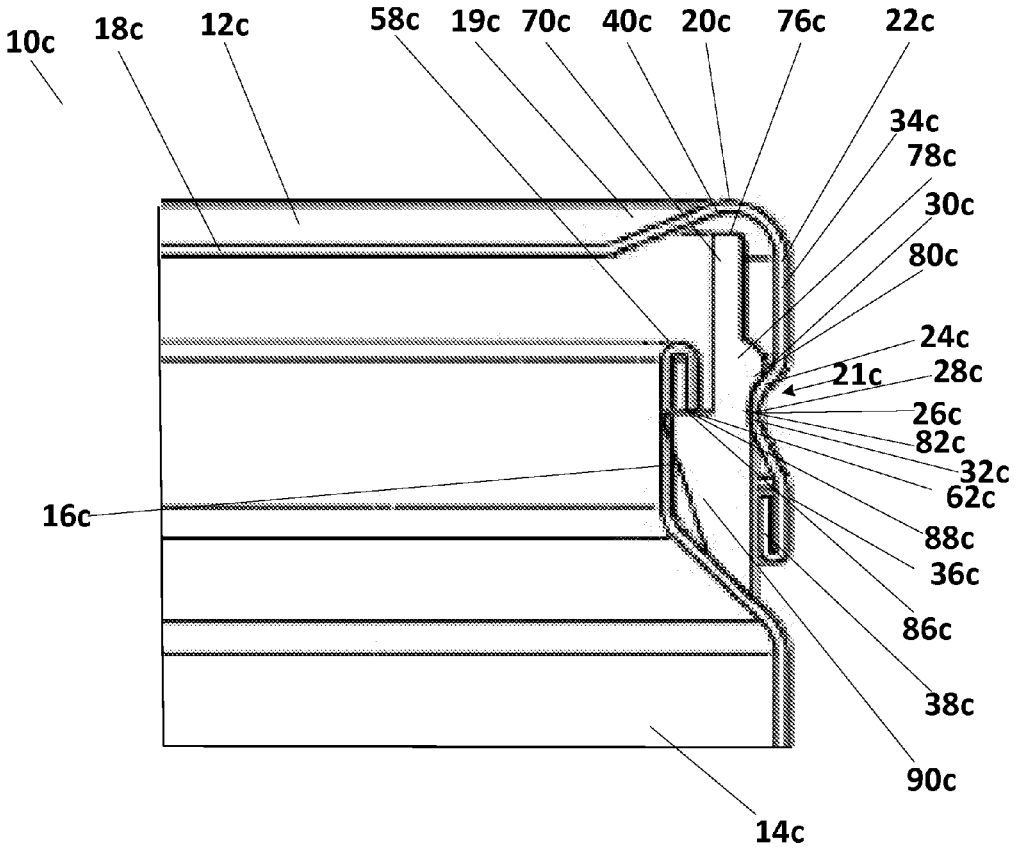
Figure 10B:
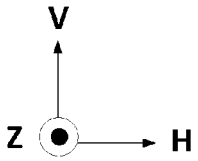
Figure 10C:
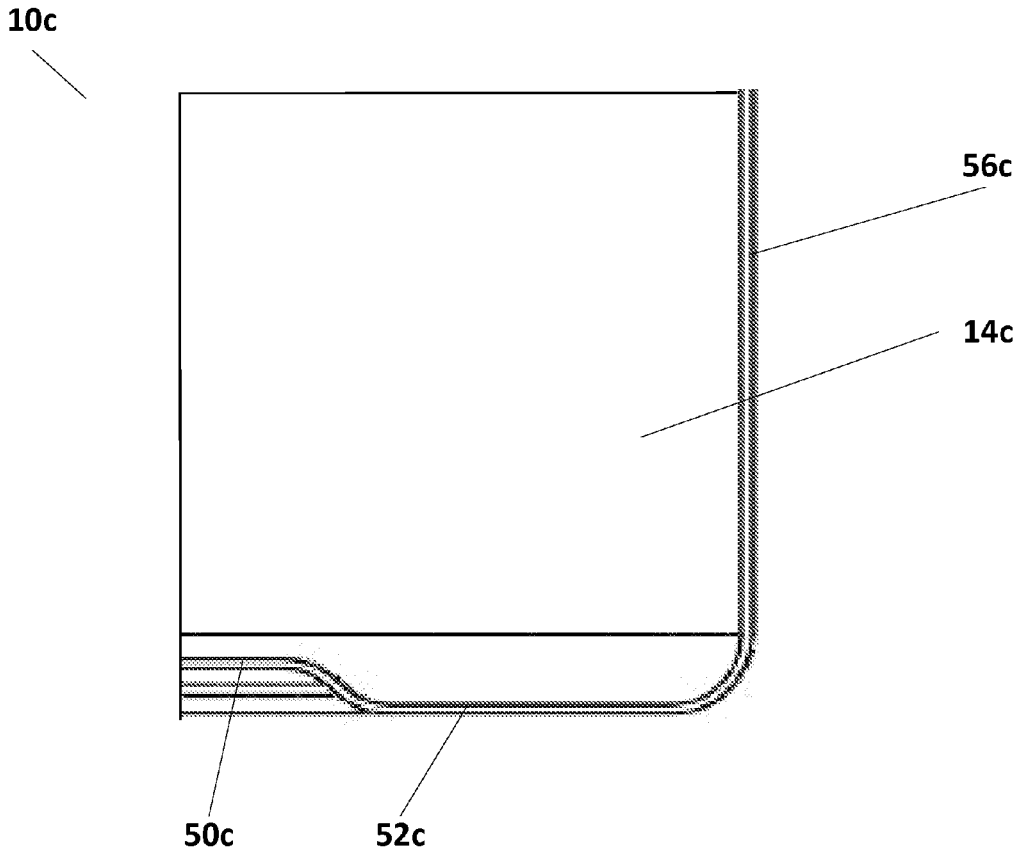
Figure 10C:
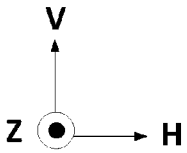
Figure 11:
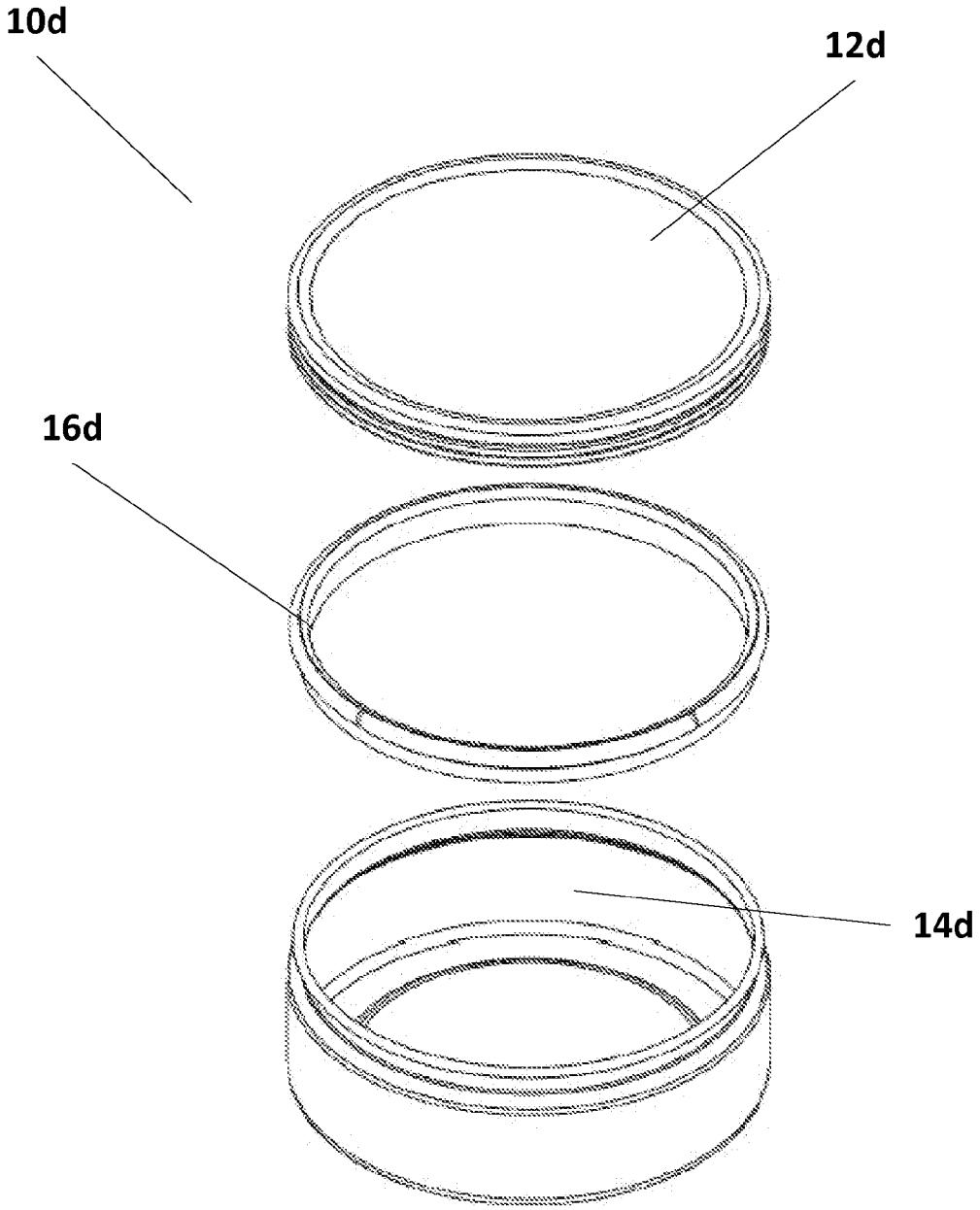
FIG. 11 illustrates a perspective exploded view of a container 10*d* that includes a lid 12*d*, cup 14*d*, and insert body 16*d*.
Figure 12A:
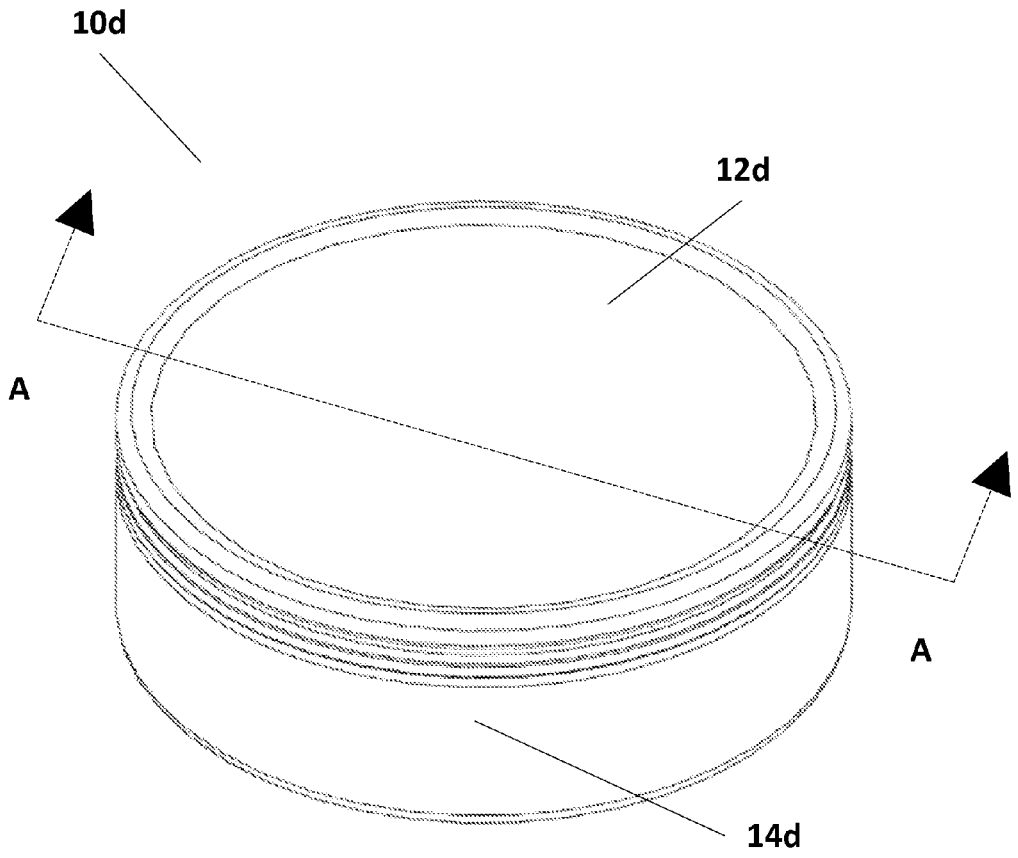
FIG. 12A illustrates a perspective view of the container 10*d* when the cup 14*d* is coupled to the insert body 16*d* and the insert body 16*d* is releasably coupled to the lid 12*d*.
Figure 12B:
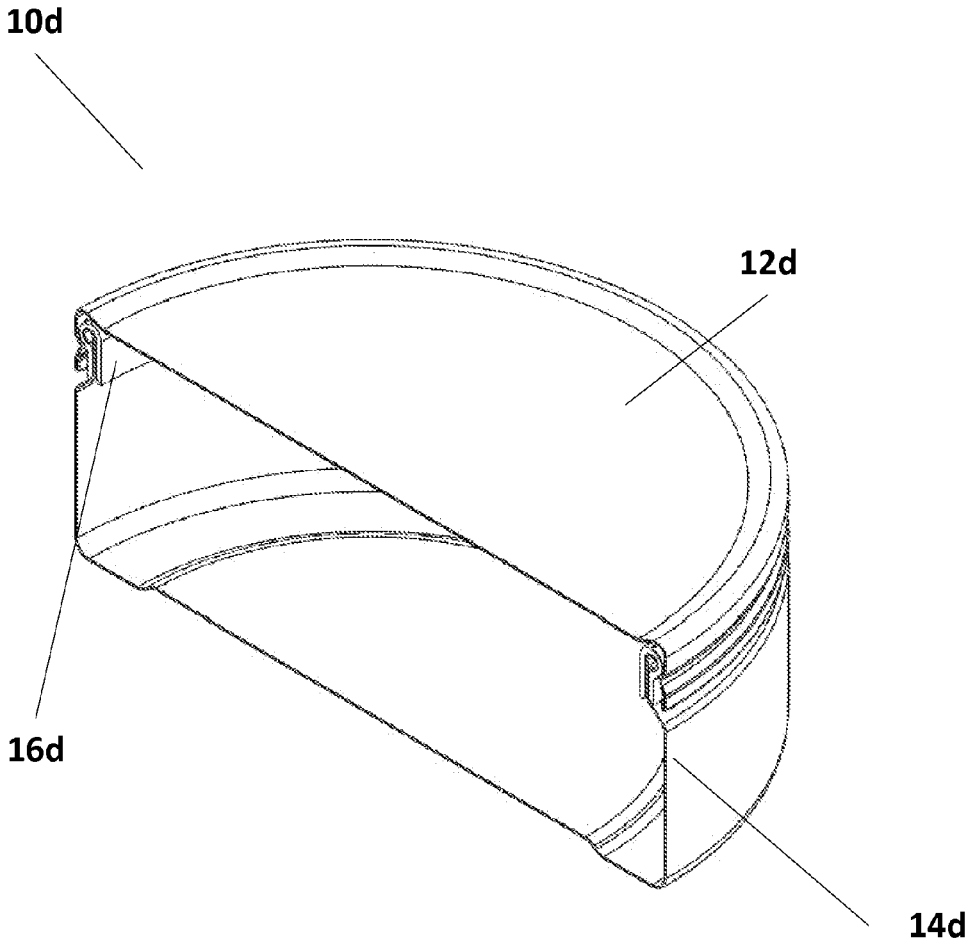
FIG. 12B illustrates a perspective cross-sectional view of the container 10*d*.

As depicted in FIG. 10B, fold 38*c* may be formed as an approximately 180° bend in the lid sidewall 22*c* that extends radially inwardly from the outer surface of the sidewall towards the vertical axis V at the bottom portion of the lid 12*c*. The fold 38*c* is configured to be proximate an outer surface of the insert body 16*c*.

In some embodiments, the lid 12*c* may be configured of sheet metal of any suitable thickness. Alternatively, the lid 12*c* is constructed of other materials, such as plastic. Features of the lid 12*c* may have varying thicknesses and surface finishes with respect to one another.

With continued reference to FIGS. 8-10C, container 10*c* also includes the cup 14*c*. The cup 14*c* includes a bottom panel 50*c*, a contact surface 52*c*, a cup sidewall 56*c*, a curl 58*c*, and a curl lip 62*c*. The figures show the cup 14*c* as having a partially cylindrical shape. In alternate embodiments, the cup may be any suitable shape such that substantially corresponds to the shape of the insert body 16*c*.

The bottom panel 50*c* extends radially outward from the vertical axis V. The bottom panel 50*c* may be planar and can define a bottom surface of the container 10*c*. The bottom panel 50*c* can be recessed (that is, spaced apart from a surface on which cup 14*c* rests). In other embodiments, the bottom panel 50*c* may not be recessed. For example, the bottom panel 50*c* may define a flat planar surface across the bottom surface of the cup 14*c*. Alternatively, the bottom panel 50*c* may protrude downwardly. When present, the recess may be any suitable size, in regards to width and depth.

The cup 14*c* also includes a contact surface 52*c* that may define a bottom surface of the cup 14*c*. The contact surface 52*c* extends radially outward from the bottom panel 50*c*. The cup sidewall 56*c* extends upwardly from the contact surface 52*c*. In this manner, the cup sidewall 56*c* may define a side surface of the cup 14*c*.

As shown in FIG. 10B, the curl 58*c* extends from an upper surface of the cup 14*c* and curls radially outward towards the lid 12*c*. The distal edge of the curl 58*c* may define the curl lip 62*c*. The curl lip 62*c* is shown as facing down, but may face up, radially inward or outward, or a direction therebetween. When the cup 14*c* is assembled to the insert body 16*c*, the curl lip 62*c* may abut a body contact surface 88*c* of the insert body 16*c*, as further discussed below.

Cup 14*c* may be configured of sheet metal, such as tinplate, of any suitable thickness. Alternatively, the cup 14*c* is constructed of other materials, such as plastic. Different features of the cup 14*c* may have varying thicknesses and surface finishes with respect to one another.

With continued reference to FIGS. 8-10C, insert body 16*c* may be a collar and may include a body sidewall 70*c*, an upper lip 76*c*, a body bead 78*c*, a bead lower surface 80*c*, a bead contact surface 82*c*, a shelf 86*c*, a body contact surface 88*c*, and a shelf taper 90*c*. The illustrated embodiments show the insert body 16*c* as annular, but in some embodiments, the insert body 16*c* may be any suitable shape that can be coupled to the cup 14*c* and the lid 12*c*.

The insert body 16*c* further includes body sidewall 70*c* that is continuous and extends circumferentially around the insert body 16*c*, or may be discontinuous (not shown in the figures). When the insert body 16*c* is assembled to the cup 14*c* and the lid 12*c*, the body sidewall 70*c* may define a side surface of the insert body 16*c* and the container 10*c*. While the embodiment illustrated in FIGS. 10A-10B show the body sidewall 70*c* as having a height roughly equal to the height of the lid 12*c*.

The upper lip 76*c* is defined by the top of the body sidewall 70*c*. Specifically, the upper lip 76*c* is the top edge of the insert body 16*c* that is adjacent the lid heel 20*c*. The lid heel 20*c* and the upper lip 76*c* together define the channel 40*c*. The body sidewall 70*c* further includes the body bead 78*c*, which extends radially outward towards the lid 12*c*. In FIG. 10B the body bead 78*c* is illustrated as a round bump. In some embodiments (not shown), the body bead 78*c* may comprise any suitable shape that is able to extend radially outward from the insert body 16*c*. When assembled to the lid 12*c*, the body bead 78*c* can be configured such that it abuts or is adjacent to the bead upper surface 30*c*.

The shelf 86*c* can extend radially inward from the body sidewall 70*c*. The shelf 86*c* may be continuous and extends circumferentially around an inner surface of the body sidewall 70*c*. In some embodiments, the shelf 86*c* is not continuous and instead there may be a plurality of shelves 86*c* disposed circumferentially around the inner surface of the insert body 16*c*. The shelf 86*c* may define the body contact surface 88*c*, such that when the insert body 16*c* is assembled with the cup 14*c*, the body contact surface 88*c* abuts the curl lip 62*c* of the cup 14*c*. As the shelf 86*c* protrudes inward from the body sidewall 70*c*, the lower portion of the shelf 86*c* is defined by the shelf taper 90*c*. When the insert body 16*c* is assembled with the cup 14*c*, the shelf taper 90*c* can taper radially outward away from the vertical axis V.

The insert body 16*c* may include a plastic material, such as polypropylene. The plastic material can be any plastic suitable of resisting corrosion, which may allow the interior space of the container 10*c* to store moist contents for long periods of time. The plastic material may also be configured to be elastic, such that when the insert body 16*c* is coupled with the cup 14*c* and releasably coupled with the lid 12*c* that the insert body 16*c* does not deform or become damaged during coupling. The insert body 16*c* may also be configured to have sufficient rigidity such that when the lid 12*c* and cup 14*c* are coupled to the insert body 16*c* that the lid 12*c* and the cup 14*c* will tend to retain the coupled configuration Insert body 16*c* and cup 14*c* may be further configured to form a snap-fit in relation to one another. Specifically, insert body 16*c* may be pressed onto cup 14*c* such that the shelf taper 90*c* slides along the curl 58*c* until the curl lip 62*c* snaps onto the shelf 86*c*, securing the insert body 16*c* to the cup 14*c*.

The lid 12*c* serves as a removable cover that is configured to releasably couple with the insert body 16*c*, which in turn couples with the cup 14*c*. When the lid 12*c*, cup 14*c*, and insert body 16*c* are coupled together, this may define container 10*c* in a closed state. In the closed state the user may securely store contents within the interior space of the container 10*c*, such as smokeless tobacco. When the lid 12*c* is decoupled from the insert body 16*c* and cup 14*c*, this may define container 10*c* in an open state. When container 10*c* is an open state, this may allow the user to gain access to the stored contents within the interior space of the container 10*c*.

The lid 12*c* and the cup 14*c* may be configured such that a plurality of containers 10*c* can be stacked on top of one another. Specifically, the angled transition wall 19*c* on one container can register with the cup 14*c* of another, like container. In this manner, the center panel 18*c* may receive a corresponding protruding interface located along the bottom of a second container 10*c*, as defined by the bottom panel 50*c*.

The inventors also surmise that the center panel 18*c* may be recessed in order to minimize denting in the top surface of the lid 12*c*. Because the center panel 18*c* may be recessed this may not only define a smaller horizontal surface area that is able to be dented, but also may increase the strength of the top surface of the lid 12*c* to resist denting. The inventors also surmise that denting may be minimized because the overall weight of the container 10*c* may be less than a container that has an insert body with a bottom portion, or an insert body such as 16*a* that extends to the bottom of the cup 14*a*.

The lid sidewall 22*c*, specifically the lid upper portion 34*c*, may be configured so that the lid bead 26*c*, and bead upper surface 30*c* flex as the lid 12*c* is releasably coupled with the insert body 16*c*. Furthermore, the lid sidewall 22*c* and lid upper portion 34*c* may be constructed of a material and thickness that is capable of repeated coupling and decoupling of the lid 12*c* with the insert body 16*c*.

The bead inner peak 28*c* may structurally reinforce the lid 12*c* to retain the mechanical interference fit with the insert body 16*c*. The bead inner peak 28*c* may also serve as a gripping surface for the user when the user releasably couples and decouples the lid 12*c* from the insert body 16*c*.

The fold 38*c* may be configured to structurally reinforce the lid 12*c* to retain the coupled position with the insert body 16*c*. The lid lower portion 36*c* and the fold 38*c* may also serve as a gripping surface for the user when the user couples and decouples the lid 12*c* from the insert body 16*c*. The fold 38*c* may also serve to provide a smooth surface that is comfortable and safe to touch by the user. In this manner, the fold 38*c* may protect the user's hands from engaging sharp metal edges during the coupling and decoupling process.

The channel 40*c* may serve as a pathway for air to travel from outside the container 10*c* into the interior space of the container 10*c*. In this manner, the channel 40*c* may allow for the contents of the container to be ventilated. This may reduce unwanted growth of bacteria and other organisms within the interior of the container 10*c*. In addition to allowing ventilation, the channel 40*c* can also be configured to allow for movement of the lid 12*c*. In this manner, the lid 12*c* and the upper lip 76*c* of the insert body 16*c* may be configured such that they do not contact each other when the container 10*c* is closed. Because the lid 12*c* may not come into contact with the upper lip 76*c*, this may reduce stress on the lid 12*c*.

In some embodiments, the channel 40*c* may be configured to allow for dimensional inaccuracies that may result from tolerances shifting in the lid 12*c*, cup 14*c*, and insert body 16*c*. For example, if the body sidewall 70*c* is longer than expected, the channel 40*c* may be configured to have sufficient space to accommodate the extra length. In some embodiments, the channel 40*c* may be configured to accommodate various degrees of thermal expansion and contraction in the lid 12*c*, cup 14*c*, and the insert body 16*c*. In this manner, the lid 12*c*, cup 14*c*, and insert body 16*c* can comprise different materials and can be exposed to extreme temperature variations.

Turning now to FIGS. 11-13C, container 10*d* includes the lid 12*d*, cup 14*d*, and insert body 16*d*. The lid 12*d* includes a center panel 18*d*, an angled transition wall 19*d*, a lid heel 20*d*, and a skirt 21*d*. The skirt 21*d* extends downwardly from an outer periphery of a lid heel 20*d* and includes a lid sidewall 22*d*, an angled sidewall 24*d*, a lid bead 26*d*, a bead inner peak 28*d*, a bead upper surface 30*d*, a bead lower surface 32*d*, a lid upper portion 34*d*, a lid lower portion 36*d*, a fold 38*d*, and a channel 40*d*. The illustrated embodiments show the lid 12*d* as having a circular shape; however, lid 12*d* may be any suitable shape such that it is capable of coupling with the insert body 16*d*.

The center panel 18*d* is recessed relative the lid heel 20*d*. Angled transition wall 19*d* extends radially from the outermost portion of center panel 18*d* to merge with lid heel 20*d*. When the lid 12*d* is assembled to the insert body 16*d* and cup 14*d*, the center panel 18*d* and angled transition wall 19*d* form a top surface of the chamber of container 10*d*. The lid heel 20*d* may comprise a rounded edge that is defined by a radius of any suitable size. In some embodiments (not shown in the figures), the center panel 18*d* may not be recessed. For example, the center panel may be flush with the uppermost portion of heel, the center panel may extend above the heel, or the center panel may be sloped.

Lid sidewall 22*d* extends about the periphery of the center panel 18*d* from the lid heel 20*d* such that the lid sidewall 22*d* is perpendicular to the center panel 18*d*. The lid sidewall 22*d* has an annular shape that cooperates with the shape of insert body 16*d*. The sidewall may form any suitable shape that is capable of cooperating with a corresponding insert body.

Lid bead 26*d* extends radially inwardly relative to lid sidewall 22*d*. In other embodiments (not shown), the lid bead 26*d* may define any suitable shape such that it is capable of coupling with the corresponding coupling surface on the insert body 16*d*, and may be discontinuous. Lid bead 26*d* has a bead upper surface 30*a* and a bead lower surface 32*a*.

Figure 13A:
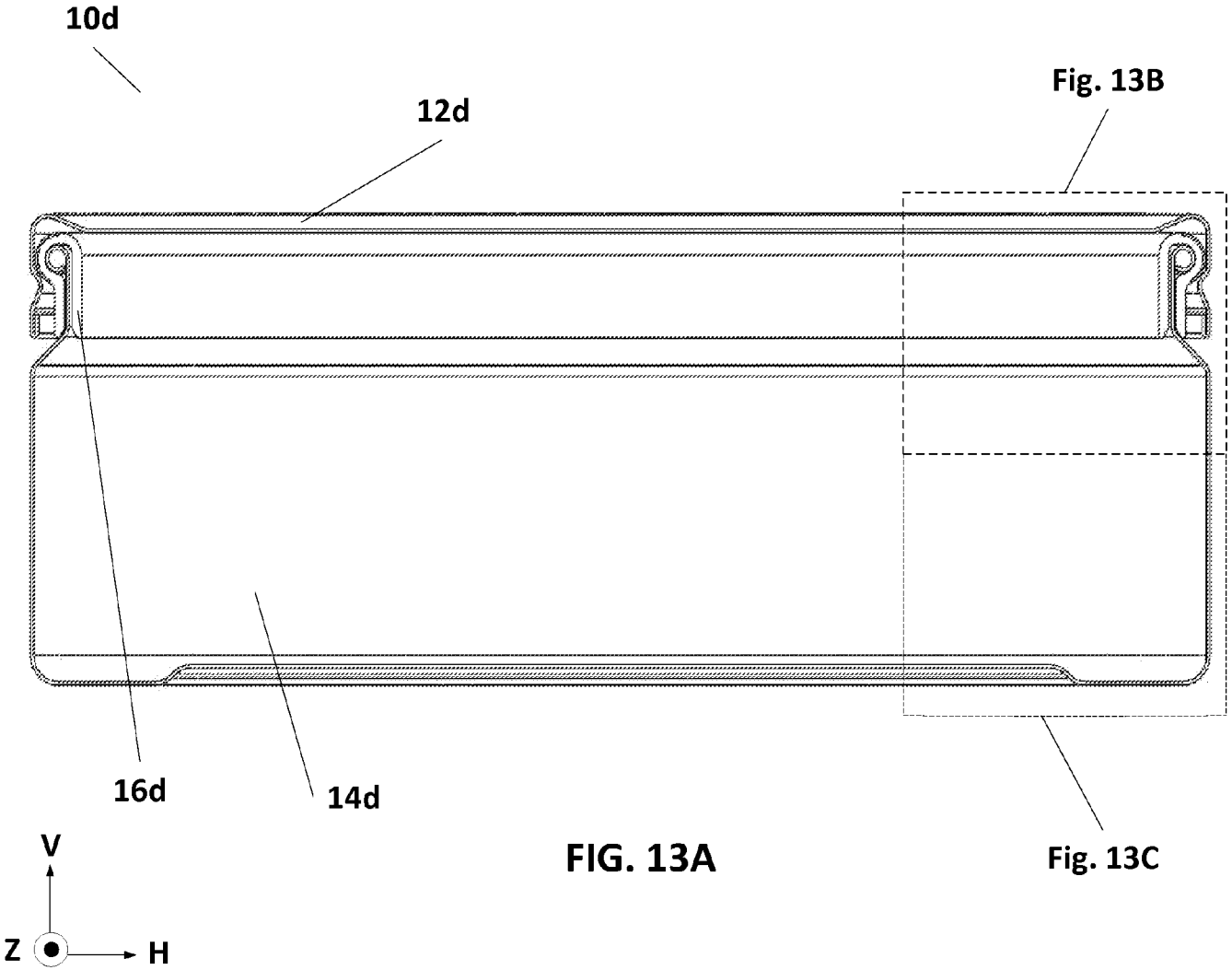
FIGS. 13A-13C illustrate various side cross-sectional views of the container 10*d*.
Figure 13B:
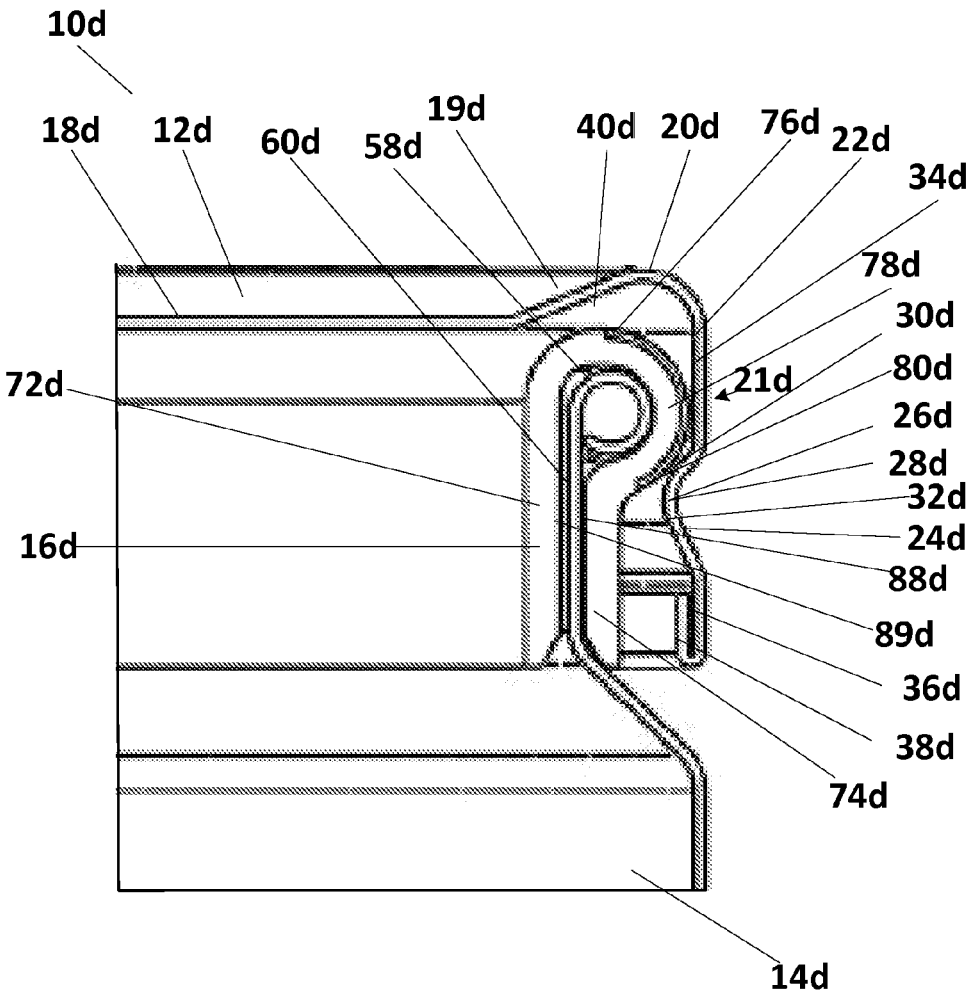
Figure 13B:
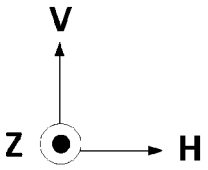
Figure 13C:
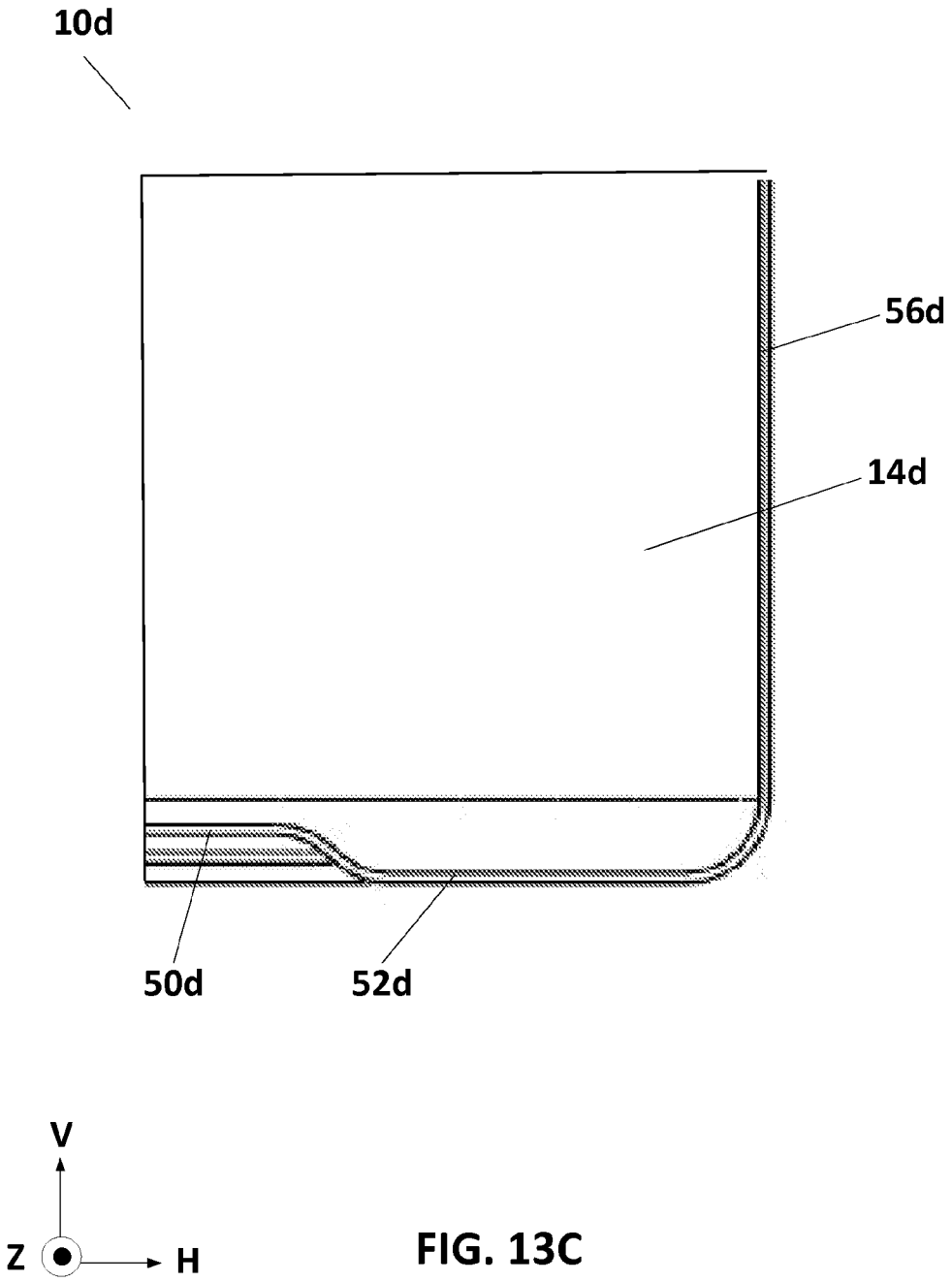

As depicted in FIG. 13B, fold 38*d* may be formed as an approximately 180° bend in the lid sidewall 22*d* that extends radially inwardly from the outer surface of the sidewall towards the vertical axis V at the bottom portion of the lid 12*d*. The fold 38*d* is configured to be proximate the body outer sidewall 74*d* of the insert body 16*d*.

In some embodiments, the lid 12*d* may be configured of sheet metal of any suitable thickness. Alternatively, the lid 12*d* is constructed of other materials, such as plastic. Features of the lid 12*d* may have varying thicknesses and surface finishes with respect to one another.

With continued reference to FIGS. 11-13C, container 10*d* also includes the cup 14*d*. The cup 14*d* includes a bottom panel 50*d*, a contact surface 52*d*, a cup sidewall 56*d*, a curl 58*d*, and a cup upper surface 60*d*. The figures show the cup 14*d* as having a partially cylindrical shape. In alternate embodiments, the cup may be any suitable shape such that substantially corresponds to the shape of the insert body 16*d*.

The bottom panel 50*d* extends radially outward from the vertical axis V. When the cup 14*d* is assembled to the insert body 16*d* and cup 14*d*, the bottom panel 50*d* may be planar and can define a bottom surface of the container 10*d*. The bottom panel 50*d* can be recessed (that is, spaced apart from a surface on which cup 14*d* rests). In other embodiments, the bottom panel 50*d* may not be recessed. For example, the bottom panel 50*d* may define a flat planar surface across the bottom surface of the cup 14*d*. Alternatively, the bottom panel 50*d* may protrude downwardly. When present, the recess may be any suitable size, in regards to width and depth.

The cup 14*d* also includes a contact surface 52*d* that may define a bottom surface of the cup 14*d*. The contact surface 52*d* extends radially outward from the bottom panel 50*d*. The cup sidewall 56*d* extends upwardly from the contact surface 52*d*. In this manner, the cup sidewall 56*d* may define a side surface of the cup 14*d*. The cup sidewall 56*d* is continuous and extends circumferentially around the vertical axis V.

As shown in FIG. 13B, the curl 58*d* extends radially outward towards the lid 12*d*. The curl 58*d* is continuous and extends circumferentially around the vertical axis V. The cup upper surface 60*d* is positioned at an upper portion of the cup 14*d*. When the cup 14*d* is assembled to the insert body 16*d* and the lid 12*d*, the cup upper surface 60*d* is configured opposite the fold 38*d*. Similar to the fold 38*d*, the cup upper surface 60*d* can be continuous and may extend circumferentially around the vertical axis V.

Cup 14*d* may be configured of sheet metal, such as tinplate, of any suitable thickness. Alternatively, the cup 14*d* is constructed of other materials, such as plastic. Different features of the cup 14*d* may have varying thicknesses and surface finishes with respect to one another.

With continued reference to FIGS. 11-13C, insert body 16*d* may be a clip and may include a body inner sidewall 72*d*, a body outer sidewall 74*d*, a upper lip 76*d*, a body curl 78*d*, a curl lower surface 80*d*, a body outer contact surface 88*d*, and a body inner contact surface 89*d*. The illustrated embodiments show the insert body 16*d* as annular, but in some embodiments, the insert body 16*d* may be any suitable shape that can be coupled to the cup 14*d* and the lid 12*d*.

The body inner sidewall 72*d* and body outer sidewall 74*d* define side surfaces of the insert body 16*d* and the container 10*d*. While the embodiment illustrated in FIGS. 13A-13B show the body inner sidewall 72*d* and body outer sidewall 74*d* having heights roughly equal to the height of the lid 12*d*. However, in some embodiments the body inner sidewall 72*d* may abut the contact surface 52*d* on a lower end and can have an upper end adjacent to the lid heel 20*d*. In other embodiments, the body inner sidewall 72*d* and body outer sidewall 74*d* may extend any suitable length between the contact surface 52*d* and the lid heel 20*d*.

The upper lip 76*d* is the upper-most surface of the insert body 16*d*. Specifically, the upper lip 76*d* is the top edge of the insert body 16*d* that is adjacent the lid heel 20*d*. Additionally, the upper lip 76*d* can be continuous and can extend circumferentially along the upper-most surface of the insert body 16*d*. In other embodiments, the surface of the upper lip 76*d* may comprise any suitable cross-sectional shape.

The insert body 16*d* further includes the body curl 78*d*, which extends radially outward from the insert body 16*d*. In FIG. 13B the body curl 78*d* is illustrated as a round curl that is continuous and extends circumferentially around the vertical axis V. However, in some embodiments, the body curl 78*d* may comprise any suitable shape that is able to extend radially outward from the insert body 16*d*. When assembled to the lid 12*d*, the body curl 78*d* can be configured such that it abuts or is adjacent to the bead upper surface 30*d*.

The body curl 78*d* further may define the curl lower surface 80*d*. The curl lower surface 80*d* is the bottom-most portion of the body curl 78*d*. Like the body curl 78*d*, the curl lower surface 80*d* can be continuous and can extend circumferentially around the insert body 16*d*.

Insert body 16*d* and cup 14*d* may be further configured to form a snap-fit in relation to one another. Specifically, insert body 16*d* may be pressed onto cup 14*d* such that the body inner sidewall 72*d* and the body outer sidewall 74*d* slide along the curl 58*d* until the curl lower surface 80*d* snaps under the curl 58*d*, securing the insert body 16*d* to the cup 14*d*.

The insert body 16*d* may include a plastic material, such as polypropylene. The plastic material can be any plastic suitable of resisting corrosion, which may allow the interior space of the container 10*d* to store moist contents for long periods of time. The plastic material may also be configured to be elastic, such that when the insert body 16*d* is coupled with the cup 14*d* and releasably coupled with the lid 12*d* that the insert body 16*d* does not deform or become damaged during coupling. The insert body 16*d* may also be configured to have sufficient rigidity such that when the lid 12*d* and cup 14*d* are coupled to the insert body 16*d* that the lid 12*d* and the cup 14*d* will tend to retain the coupled configuration.

The lid 12*d* serves as a removable cover that is configured to releasably couple with the insert body 16*d*, which in turn couples with the cup 14*d*. When the lid 12*d*, cup 14*d*, and insert body 16*d* are coupled together, this may define container 10*d* in a closed state. In the closed state the user may securely store contents within the interior space of the container 10*d*, such as smokeless tobacco. When the lid 12*d* is decoupled from the insert body 16*d* and cup 14*d*, this may define container 10*d* in an open state. When container 10*d* is an open state, this may allow the user to gain access to the stored contents within the interior space of the container 10*d*.

The lid 12*d* and the cup 14*d* may be configured such that a plurality of containers 10*d* can be stacked on top of one another. Specifically, the angled transition wall 19*d* on one container can register with the cup 14*d* of another, like container. In this manner, the center panel 18*d* may receive a corresponding protruding interface located along the bottom of a second container 10*d*, as defined by the bottom panel 50*d*.

The inventors also surmise that the center panel 18*d* may be recessed in order to minimize denting in the top surface of the lid 12*d*. Because the center panel 18*d* may be recessed this may not only define a smaller horizontal surface area that is able to be dented, but also may increase the strength of the top surface of the lid 12*d* to resist denting. The inventors also surmise that denting may be minimized because the overall weight of the container 10*d* may be less than a container that has an insert body with a bottom portion, or an insert body such as 16*a* that extends to the bottom of the cup 14*a*.

The lid bead 26*d* and bead upper surface 30*d* may couple with the insert body 16*d*, specifically the body curl 78*d* and the curl lower surface 80*d*. The lid bead 26*d* and bead upper surface 30*d* may be configured to create a mechanical interference with the body curl 78*d* and the curl lower surface 80*d*. In this manner, the lid 12*d* can releasably couple with the insert body 16*d*.

The lid bead 26*d* and bead upper surface 30*d* flex as the lid 12*d* is releasably coupled with the insert body 16*d*. Furthermore, the lid sidewall 22*d* and lid upper portion 34*d* may be constructed of a material and thickness that is capable of repeated coupling and decoupling of the lid 12*d* with the insert body 16*d*.

The bead inner peak 28*d* may structurally reinforce the lid 12*d* to retain the mechanical interference fit with the insert body 16*d*. The bead inner peak 28*d* may also serve as a gripping surface for the user when the user releasably couples and decouples the lid 12*d* from the insert body 16*d*.

The fold 38*d* may be configured to structurally reinforce the lid 12*d* to retain the coupled position with the insert body 16*d*. The lid lower portion 36*d* and the fold 38*d* may also serve as a gripping surface for the user when the user couples and decouples the lid 12*d* from the insert body 16*d*. The fold 38*d* may also serve to provide a smooth surface that is comfortable and safe to touch by the user. In this manner, the fold 38*d* may protect the user's hands from engaging sharp metal edges during the coupling and decoupling process.

The channel 40*d* may serve as a pathway for air to travel from outside the container 10*d* into the interior space of the container 10*d*. In this manner, the channel 40*d* may allow for the contents of the container to be ventilated. This may reduce unwanted growth of bacteria and other organisms within the interior of the container 10*d*. In addition to allowing ventilation, the channel 40*d* can also be configured to allow for movement of the lid 12*d*. In this manner, the lid 12*d* and the upper lip 76*d* of the insert body 16*d* may be configured such that they do not contact each other when the container 10*d* is closed. Because the lid 12*d* may not come into contact with the upper lip 76*d*, this may reduce stress on the lid 12*d*.

In some embodiments, the channel 40*d* may be configured to allow for dimensional inaccuracies that may result from tolerances shifting in the lid 12*d*, cup 14*d*, and insert body 16*d*. For example, if the insert body 16*d* is longer than expected, the channel 40*d* may be configured to have sufficient space to accommodate the extra length. In some embodiments, the channel 40*d* may be configured to accommodate various degrees of thermal expansion and contraction in the lid 12*d*, cup 14*d*, and the insert body 16*d*. In this manner, the lid 12*d*, cup 14*d*, and insert body 16*d* can comprise different materials and can be exposed to extreme temperature variations.

The various features described with respect to each of the four embodiments are all interchangeable amongst other embodiments. For example, the 14*d* may be coupled with the insert body 16*b* and the lid 12*a*. This is just one example of one combination. Any combination of individual features from separate embodiments may be used with each other.

The drawings show specific embodiments in which the present application may be practiced, by way of example or illustration and not by way of limitation. The embodiments may be combined, other examples or embodiments may be utilized, or structural, logical and mechanical changes may be made without departing from the scope and spirit of the claimed features of the present application. The description is, therefore, not to be taken in a limiting sense. The above description is intended to be illustrative, and not restrictive. As such, the above embodiments and aspects thereof may be used in combination with each other. Many other embodiments will be apparent to those skilled in the art after reading the above description. While the foregoing written description of the present application enables one of ordinary skill to make and use the claimed features of the present application, those of ordinary skill will understand and appreciate the existence of variations, permutations, combinations, equivalent means, and equivalents of the specific embodiments, methods, and examples herein. The present application should therefore not be limited by the above described embodiments, methods, and examples, but by all embodiments and methods within the scope and spirit of the present application as claimed.

What is claimed:

1. A tobacco container comprising:

a lid including a top panel and a peripheral sidewall;

a cup including a bottom panel, a peripheral sidewall, and a beveled heel disposed radially inward to the peripheral sidewall of the cup; and an open-bottom sleeve coupled to the cup and releasably coupled to the lid, the sleeve including a sidewall, a lip, and a living hinge that connects the sidewall of the sleeve and the lip, the living hinge having a maximum thickness that is less than maximum thicknesses of the sidewall of the sleeve and the lip, and the lip having a tip that contacts the beveled heel.

2. The tobacco container of claim 1, wherein the beveled heel is disposed at an outer periphery of the bottom panel, the top panel of the lid defines a recessed center panel and the beveled heel is configured to nest into the recessed center panel.

3. The tobacco container of claim 1, wherein the lid and cup comprise sheet metal.

4. The tobacco container of claim 1, wherein the open-bottom sleeve comprises plastic.

5. The tobacco container of claim 1, wherein the lip is tapered to the tip, the taper being configured to deflect the lip in a direction opposite the peripheral sidewall of the cup.

6. The tobacco container of claim 5, wherein the tip is configured to minimize the potential for tobacco to be inaccessible to a user.

7. The tobacco container of claim 1, wherein the peripheral sidewall of the lid defines a lid bead that is configured to releasably couple with the sleeve, and wherein an upper portion of the sidewall of the sleeve defines a sleeve bead that is configured to releasably couple with the lid bead.

8. The tobacco container of claim 1, wherein a middle portion of the sidewall of the sleeve defines a shelf that is configured to couple with the cup, and wherein the cup defines a lip at an upper portion of the peripheral sidewall of the cup that is configured to couple with the shelf.

9. The tobacco container of claim 1, wherein an inner surface of the cup is coated.

10. The tobacco container of claim 1, wherein the sidewall of the sleeve is located vertically inline and above the beveled heel.

11. The tobacco container of claim 1, wherein the sidewall of the sleeve, the lip, and the living hinge are monolithic.

* * * * *